US009093254B2

(12) United States Patent
Rand et al.

(10) Patent No.: US 9,093,254 B2
(45) Date of Patent: Jul. 28, 2015

(54) RAPID GAS-PHASE ISOTOPIC LABELING FOR ENHANCED DETECTION OF PROTEIN CONFORMATIONS

(75) Inventors: Kasper D. Rand, Ain (FR); John R. Engen, Jamaica Plain, MA (US); Robert H. Bateman, Knutsford (GB)

(73) Assignees: Northeastern University, Boston, MA (US); Micromass UK Limited (GB)

( * ) Notice: Subject to any disclaimer, the term of this patent is extended or adjusted under 35 U.S.C. 154(b) by 508 days.

(21) Appl. No.: 13/264,574

(22) PCT Filed: Apr. 14, 2010

(86) PCT No.: PCT/US2010/031052

§ 371 (c)(1),
(2), (4) Date: Oct. 14, 2011

(87) PCT Pub. No.: WO2010/120895

PCT Pub. Date: Oct. 21, 2010

(65) Prior Publication Data

US 2012/0032073 A1 Feb. 9, 2012

Related U.S. Application Data

(60) Provisional application No. 61/169,083, filed on Apr. 14, 2009.

(51) Int. Cl.
*H01J 49/00* (2006.01)

(52) U.S. Cl.
CPC ..... *H01J 49/0077* (2013.01)

(58) Field of Classification Search
CPC ..... H01J 49/00; H01J 49/0077
See application file for complete search history.

(56) References Cited

U.S. PATENT DOCUMENTS

| | | | | |
|---|---|---|---|---|
| 5,206,506 | A | 4/1993 | Kirchner | |
| 5,451,781 | A | 9/1995 | Dietrich et al. | |
| 6,291,189 | B1 | 9/2001 | Woods, Jr. | |
| 6,791,078 | B2 * | 9/2004 | Giles et al. | 250/286 |

(Continued)

OTHER PUBLICATIONS

Winger et al., "Probing Qualitative Conformation Differences of Multiply Protonated Gas-Phase Proteins via H/D Isotopic Exchange with D2O", Journal of American Chemical Society, 1992, vol. 114, pp. 5897-5898.*

(Continued)

*Primary Examiner* — Jack Berman
(74) *Attorney, Agent, or Firm* — Wilmer Cutler Pickering Hale and Dorr LLP

(57) ABSTRACT

A mass spectrometer (MS) that is adapted to allow rapid gas-phase hydrogen/deuterium exchange (HDX) labeling of ions in one or more traveling wave ion guides (TWIGs) with or without ion mobility separation. The addition of isotopic labeling by gas-phase HDX offers a sensitive alternative dimension for conformational detection, which enables high resolution detection of gaseous conformations based on shape and surface reactivity. Gas-phase, isotopic HDX labeling or "curtain" labeling, can be performed by infusing a reactive, isotopic labeling gas, e.g., $ND_3$, into one or more of the traveling-ion wave guides (TWIG) in the MS. Analyte ions retained in the potential wells of a traveling wave generated by one or more of the TWIGs can be isotopic labeled at adjustable gas pressures. Labeling times can also be controlled by adjusting the speed of the traveling wave and can be performed within milliseconds of ionizations, probing protein conformations present in solution.

30 Claims, 17 Drawing Sheets

(56) References Cited

U.S. PATENT DOCUMENTS

| | | | | |
|---|---|---|---|---|
| 6,800,846 | B2 * | 10/2004 | Bateman et al. | 250/281 |
| 6,828,550 | B2 * | 12/2004 | Griffey et al. | 250/281 |
| 7,071,467 | B2 * | 7/2006 | Bateman et al. | 250/292 |
| 2008/0191129 | A1 | 8/2008 | Makarov et al. | |
| 2013/0206974 | A1 * | 8/2013 | Brown | 250/282 |

OTHER PUBLICATIONS

Nagy et al., "Online Hydrogen/Deuterium Exchange Performed in the Ion Mobility Cell of a Hybrid Mass Spectrometer", Analytical Chemistry, vol. 81, No. 22 (Nov. 15, 2009), pp. 9365-9371.*

Valentine et al., "H/D Exchange Levels of Shape-Resolved Cytochrome c Conformers in the Gas Phase", Journal of the American Chemical Society, (1997), vol. 119, pp. 3558-3566.*

Rand et al. "Gas-phase hydrogen/deuterium exchange in a travelling wave ion guide for the examination of protein conformations", Analytical Chemistry, vol. 81, No. 24 (Dec. 15, 2009), pp. 10019-10028.*

Winger et al, "Gas-Phase Proton Transfer Reactions Involving Multiply Charged Cytochrome c Ions and Water Under Thermal Conditions", Journal of the American Society for Mass Spectrometry, 1992, 3, 624-630.*

Valentine et al., "H/D Exchange Levels of Shape-Resolved Cytochrome c Conformers in the Gas Phase", Journal of the American Chemical Society, 1997, 119, 3558-3566.*

* cited by examiner

RAPID GAS-PHASE ISOTOPIC LABELING FOR ENHANCED DETECTION OF PROTEIN CONFORMATIONS

CROSS REFERENCE TO RELATED APPLICATIONS

Cross Reference to Related Applications

This application is a national state filing under 35 U.S.C. 371 of International Application PCT/US2010/031052, filed Apr. 14, 2010, entitled RAPID GAS-PHASE ISOTOPIC LABELING FOR ENHANCED DETECTION OF PROTEIN CONFORMATIONS, and claims the benefit of priority of U.S. Provisional Patent Application No. 61/169,083 filed Apr. 14, 2009, all of which are incorporated herein by reference.

STATEMENT REGARDING FEDERALLY SPONSORED RESEARCH OR DEVELOPMENT

N/A

BACKGROUND OF THE INVENTION

1. Field of the Invention

The present invention is directed to a device, system, and method for improved detection of gas-phase conformations of, for example, protein-ligand complexes, functional macromolecular protein assemblies, and the like, and, more particularly, to a device, system, and method that use rapid deuterium labeling in a traveling-wave ion guide of a mass spectrometer performed alone or in tandem with ion mobility separation for improved detection.

2. Summary of the Related Art

Numerous studies have demonstrated that protein-ligand complexes and even large functional macromolecular protein assemblies can retain their non-covalent bonding when in the gas phase. This phenomenon enables the determination of stoichiometry and binding interactions by various gas-phase techniques such as limited collisional dissociation and ion mobility separation. In contrast, smaller globular proteins appear to adopt a multitude of gas-phase conformations depending on the condition of the electrospray process and the amount of time that elapses before detection. Although this conformational ensemble likely extends beyond that present in solution, gas-phase conformations of globular proteins offer a window into the non-native and solvent-free conformational landscape including intermediates along, for example, folding pathway and trapped misfolded species.

This information can be relevant for understanding important areas of biology such as protein folding, protein aggregation, and amyloid formation. Furthermore, several recent experimental studies suggest that solution-phase conformers of even small globular proteins can be largely preserved for 30-60 milliseconds following electrospray ionization (ESI). To take advantage of this phenomenon, sensitive analytical tools are needed for the rapid characterization of conformations of both small globular proteins and large macromolecular complexes in the gas phase.

Several techniques are available for interrogating the conformational properties of gaseous protein ions. These techniques include ion mobility spectrometry by which ions in an inert bath gas at high pressure are separated by drift-time and measurement of the kinetics of gas-phase chemistry such as proton transfer reactions, hydrogen/deuterium exchange (HDX), and the like. Although ion mobility spectrometry has proved an invaluable tool and has recently been introduced in commercially-available instruments, gas-phase HDX measurements provide an additional dimension for conformational interrogation that ion mobility spectrometry alone cannot provide.

Indeed, in a pioneering study by others, gas-phase HDX was used to provide some of the first experimental evidence of stable, coexisting, gas-phase, protein conformations. Other studies have shown that gas-phase HDX can sometimes expose the presence of additional gas-phase protein conformers not resolved by ion mobility spectrometry, and vice versa. Measuring the HDX of proteins in solution by mass spectrometry is an established method. Recent developments further enable the measurement of deuterium levels of individual amide hydrogen ions, similar to NMR spectroscopy. In contrast, mass spectrometric detection of gas-phase HDX has yet to see wide-spread use in biological research and the emerging field of native mass spectrometry. By combining conformation information obtained with solution HDX and those of gas-phase HDX experiments, it is possible to determine more definitively which conformations, present in the gas-phase shortly after ionization, are the same as those existing in solution.

In the field of mass spectrometry, chemical compounds can be ionized to generate charged molecules or molecule fragments from which their mass-to-charge ratios (m/z) can be measured, e.g., in a time-of-flight mass spectrometer (TOF-MS). Typically, mass spectrometers (MS) include an ion source, a mass analyzer, and a detector. The ion source converts molecules from a solution sample into ions, which are then sorted in the presence of an electromagnetic field according to mass by the mass analyzer. The detector measures the quantity of discrete ions present.

Isotopic labeling studies of gaseous proteins have typically been confined to mass spectrometers having custom-built ion traps/drift-tubes or Fourier transform-ion cyclotron resonance (FT-ICR) instruments. Ion traps use electric fields, e.g., a Paul trap, to capture ions and to determine their mass-to-charge ratio (M/z). A FT-ICR cell instrument uses a combination of electric and magnetic fields to trap ions in the confined volume of the ICR cell, e.g., a Penning trap, and determines the m/z value of ions based on the cyclotron frequency of ions in the fixed magnetic field. For gas-phase, isotopic labeling experiments in both ion traps or FT-ICR cells, a deuterated bath gas is introduced into the trap/cell so that the trapped molecules can be incubated in the presence of the bath gas for various periods of time.

Numerous gas-phase HDX studies have been performed using FT-ICR instruments in which ions are labeled while stored in an external RF-only ion guide or where ions are contained in the ICR cell. This enables defined ion-molecule reaction times from seconds to hours. Trapping ions in multipole-type ion reservoirs rather than in ICR cells facilitates the use of higher reagent gas-pressures and shorter gas-phase labeling times, e.g., less than 50 msec. The continuous accumulation of ions in an external ion reservoir during a gas-phase HDX reaction, however, can give rise to complex exchange kinetics as ions of the same origin are labeled for different amounts of time depending on their time of entry into the ion reservoir. Furthermore, filling the ion reservoir beyond its space charge limit can result in vibrational excitation and dissociation, which can further complicate interpretation of HDX kinetics. Notably, such issues have been addressed with custom-designed, gated-beam ESI sources having ion shutters and/or by using a MALDI source that does not produce continuous ion beams.

Accordingly, it would be desirable to provide a device, system, and method for performing gas-phase HDX labeling of the conformations of known or unknown ions in a traveling wave ion guide. Moreover, it would be desirable to accomplish this in tandem with ion mobility separation.

BRIEF SUMMARY OF THE INVENTION

A mass spectrometer (MS) that is adapted to perform gas-phase hydrogen/deuterium exchange (HDX) labeling of ions with or without ion mobility separation is disclosed. Gas-phase HDX offers a sensitive alternative dimension for conformational detection, and the application of isotopic labeling in tandem with ion mobility separation enables high resolution detection of gaseous conformations, e.g., of protein-ligand complexes, of large functional macromolecular protein assemblies, and so forth, based on shape and surface reactivity.

Gas-phase, isotopic HDX labeling, or "curtain" labeling, can be performed by infusing a labeling gas, e.g., $ND_3$, $D_2O$, and the like, into one or more of the traveling-ion wave guides (TWIG) in the MS. Advantageously, localized deuterium labeling can be performed in a low-pressure environment of the TWIG by which ion reaction times can be controlled without interfering with the exchange process of water vapor from laboratory (ambient) air.

Analyte ions retained in the (voltage) potential wells of a traveling wave generated by one or more of the TWIGs can be labeled at adjustable gas pressures, e.g., between $0.1\times10^{-3}$ mbar and 0.1 mbar depending on the choice of TWIG. Labeling times, e.g., 0.1 msec to 10 msec, can be controlled by adjusting the speed of the traveling wave.

BRIEF DESCRIPTION OF THE SEVERAL VIEWS OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

Furthermore, the invention will be more fully understood by referring to the Detailed Description of the Invention in conjunction with the Drawings, of which.

DETAILED DESCRIPTION OF THE INVENTION

U.S. provisional patent application No. 61/169,083 filed on Apr. 14, 2009 is incorporated herein in its entirety.

Figure 1:
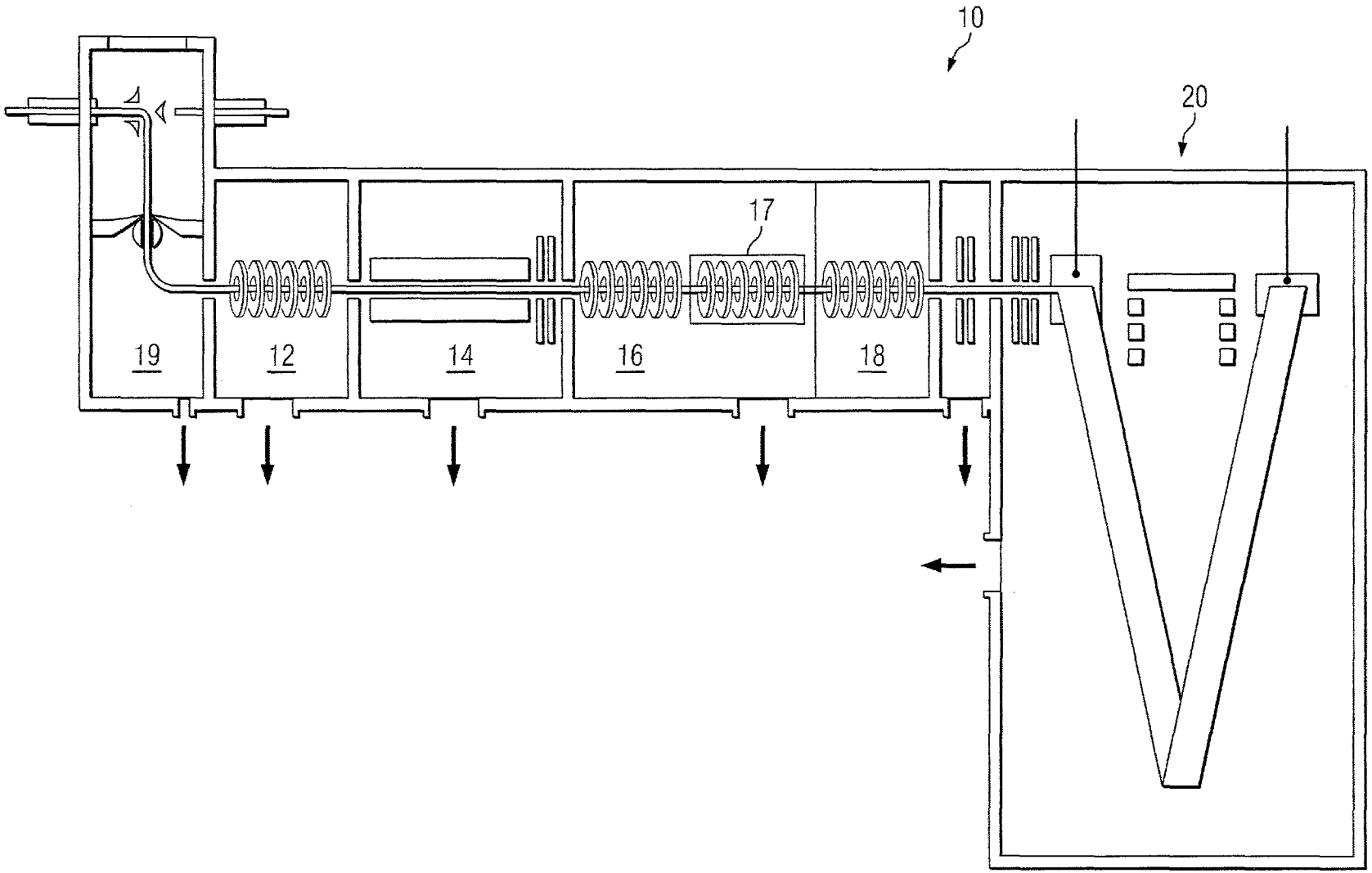
FIG. 1 provides a diagrammatic view of a mass spectrometer.

Referring to FIG. 1, a mass spectrometer (MS), e.g., a time-of-flight mass spectrometer (TOF-MS) such as the Synapt™ MS manufactured by Waters Corporation of Milford, Mass., is shown. The MS 10 includes an ion source 19, a first (source) traveling wave ion guide (TWIG) 12, a quadrupole 14, a trap-TWIG 16, a mobility-TWIG 17, a transfer-TWIG 18, and a time-of flight (TOF) detector 20. The functions of the detector 20 and the ion source 19 of the MS 10 are well known and will not be described in great detail except as necessary to describe their interaction with the TWIGs 12, 16, 17, and 18.

The intermediate pressure environment of an ion in a traveling wave is highly suited for very fast, localized deuterium labeling. By performing "curtain" labeling in the source-TWIG 12, the trap-TWIG 16, the mobility-TWIG 17 or the transfer-TWIG 18, protein ions are probed by gas-phase HDX within a few milliseconds after electrospray ionization (ESI). For example, labeling in the source-12 or transfer-TWIG 18 probes the ions only for about 0.1 msec to 10 msec. By the use of highly reactive $ND_3$ gas at elevated pressures, a high efficiency of gas-phase HDX of protein ions can be achieved, corresponding to deuteration of 50-80% of side-chain positions or 25-50% of all labile hydrogen ions in less than a millisecond, depending on the protein. This allows users to extract information about gaseous ion structure during very short HDX reaction times. Moreover, the conformations revealed in these short times better reflect the conformational landscape of protein ions at the conditions of electrospray.

For longer labelling time-scales, such as in some other instrumental set-ups, gas-phase protein conformers have been shown to interconvert. As a result, labelling observed at such time-scales can be affected by the presence of any exchange-competent states not present shortly after ionization. In contrast, the described rapid, gas-phase HDX in a TWIG will be useful for probing biologically-relevant states of single proteins and large protein-protein complexes occurring shortly after ESI at native state conditions. It also facilitates defining which solution conformations are retained in the gas-phase.

By performing gas-phase HDX in the transfer-TWIG 18 of a Synapt™ mass spectrometer 10, it becomes possible to carry out ion mobility separation and HDX analysis in tandem, thereby probing the same population of ions in two orthogonal dimensions of conformational detection. The utility of a TWIG for other types of gas-phase reactions could easily be envisioned for instance for harboring charge-stripping reagent gases, inert gases for collisional activation or radical anions for electron transfer dissociation. For instance, multiple gas-phase reactions could be performed in sequence with isotopic labeling by two or more TWIGs placed in tandem. Furthermore, labeling gaseous protein ions with this methodology allows for controllable ion-molecule reaction times without interference from water vapor or air.

Each traveling wave ion guide 12, 16, 17, and 18 (TWIG or "ion guide") enables well-defined ion propulsion (mobility) through a background (bath) gas, e.g., a gas pressurized to between $10^{-3}$ mbar and $10^{-1}$ mbar, using a traveling (voltage) potential wave (or "T-wave"). For example, referring to FIGS. 2 and 2A, for ion transport through the transfer-TWIG 18, a stack of ring electrodes 30 that are structured and arranged to provide a center annular region 35 therethrough, are selectively activated, i.e., turned ON (1 or voltage HI) and OFF (0 or voltage LO), to progressively retain ions 33 in a potential well 31 of the T-wave. Ions 33 are propelled through the stack of ring electrodes 30 at a controllable and adjustable speed by selectively imposing a radially-confining RF pulse to one set of electrodes 30*a* and then moving this pulse to the next set of electrodes 30*b*, producing a moving electric field or potential wave 31 that moves ions 33 through the center annular region 35 of the ion guide.

Figures 2, 2A, 2B:
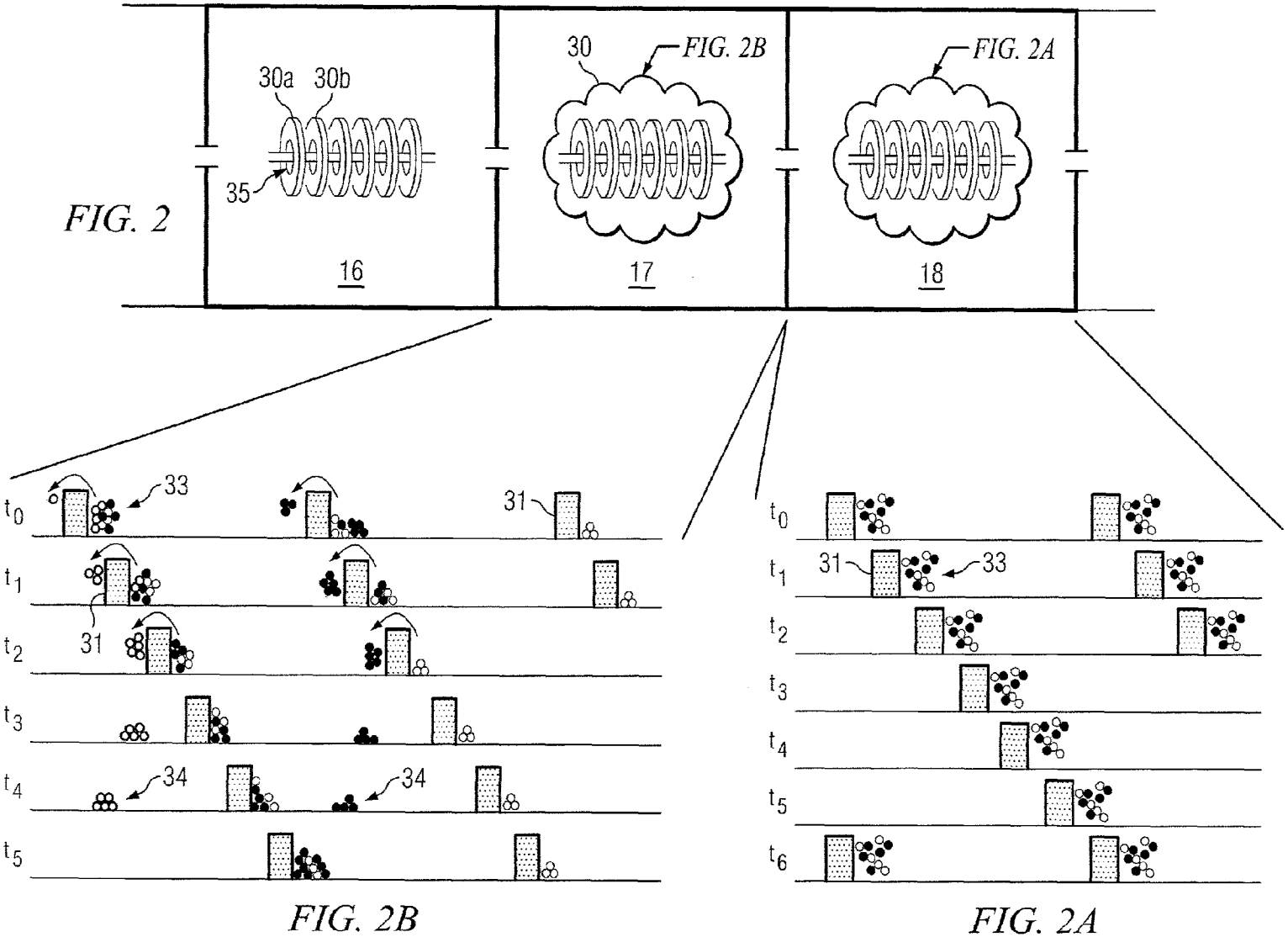
FIG. 2 shows a diagrammatic view of the ring electrodes of an ion guide.
FIG. 2A shows a diagrammatic view of ion roll-over during ion mobility separation.
FIG. 2B shows a diagrammatic view of ion transport through a transfer traveling wave ion guide.

Referring to FIG. 2B, in contrast with FIG. 2A, a T-wave passing through the mobility-TWIG 17 in the presence of a significant bath gas, e.g., $N_2$, induces further ion mobility, causing ions 34 to roll-over the sides of the potential well 31, i.e., to separate, due to, inter alia, the increased draft of ions 33 in the bath gas and to the wave height of the T-wave. Roll-over is desirable within the mobility-TWIG 17, which can segregate similar or substantially similar ions based on their collisional cross-section. This provides a first dimension of separation of conformations.

Figure 2C:
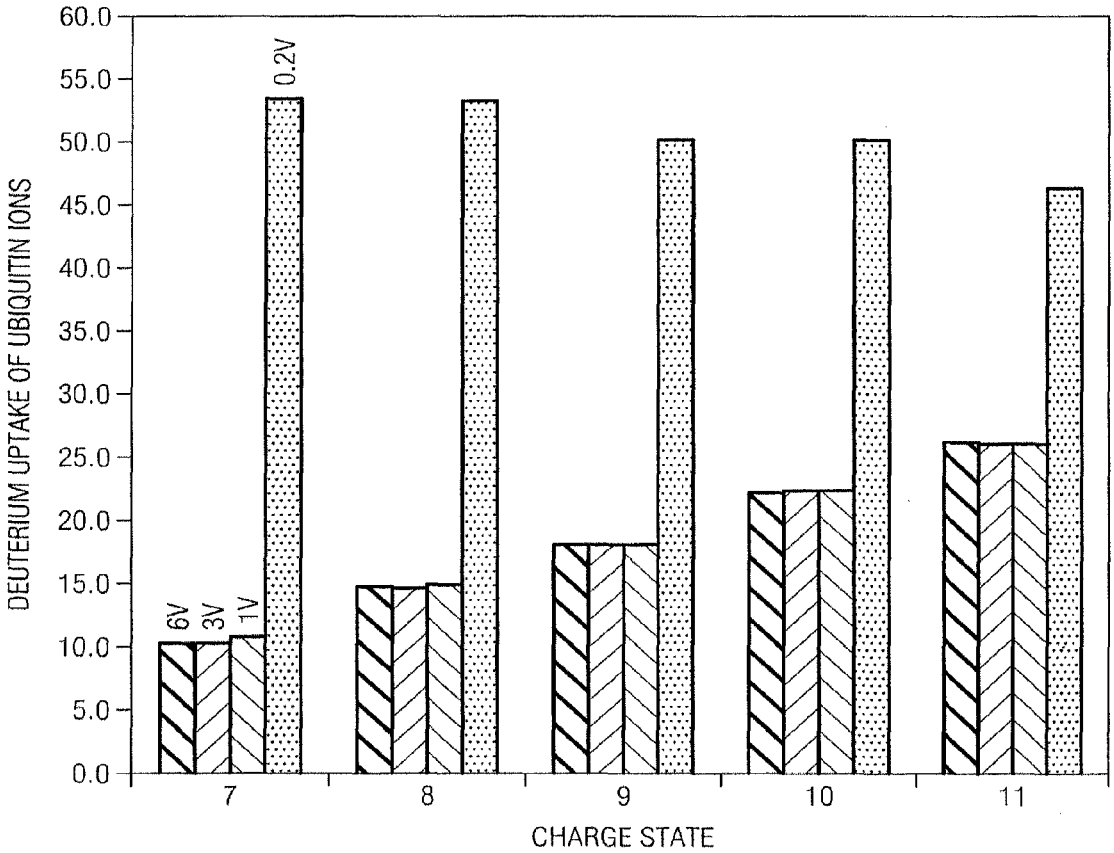
FIG. 2C shows a bar chart summarizing the effect of wave height on deuterium uptake for various charge states due to ion roll-over.

In contrast, ion roll-over is undesirable in the transfer-TWIG 18 during gas-phase HDX as the measured deuterium uptake of the gaseous ions can be skewed by ion roll-over and, hence, the results would no longer correspond to structural properties of those ions. In gas-phase HDX, increasing the wave height of the potential well 31 can permit all ions 33 to be retained in the potential well 31 without any roll-over. FIG. 2C compares the deuterium uptake of ubiquitin ions during gas-phase HDX for various wave heights. There is a transition wave height that is greater than about 0.2V and less than 1V. For ion mobility separation purposes, a wave height less than or equal to 0.2V would be beneficial. On the other hand, for gas-phase HDX purposes a wave height in excess of 1V and preferably between 3V and 6V is desirable.

Wave height in any of the ion guides is adjustable and controllable. Hence, once wave height is established, the residence time, i.e., the labeling time, of the ions 33 within a TWIG of fixed dimension (length) is determined by, and can be controlled by, the speed of the traveling wave, i.e., the "wave speed". Advantageously, because the residence time of ions 33 can be controlled and because gas pressures in any of the TWIGs can operate at a much higher pressure relative to that of ion traps and/or ICR cells, TWIGs are ideal places to perform gas-phase HDX, where higher pressures produce a greater exchange.

The ability to control the speed of the T-wave allows relatively short, e.g., between 0.1 msec and 10 msec, labeling times to be carried out. Advantageously, this provides the means to probe the near-native, compact folds of protein ions immediately after ESI.

Preferably, ions are isotopically labeled, or "probed", "on-the-fly" while confined in the potential wells 31 of T-wave as they are transported through the center annular region 35 of the stacked-ring ion guide. In contrast to external ion reservoirs, the unique properties of the TWIG ensure that all ions 33 moving through the ion guide are labeled for the same amount of time as a function of the speed of the T-wave, without requiring a discontinuous ion-beam. This ensures that all of the ions have the same dwell time and equal exposure time to the labeling gas. The instrumental setup should, therefore, also be readily compatible with online liquid chromatography, enabling gas-phase HDX of individual peptide or protein components from complex mixtures.

Figure 3A:
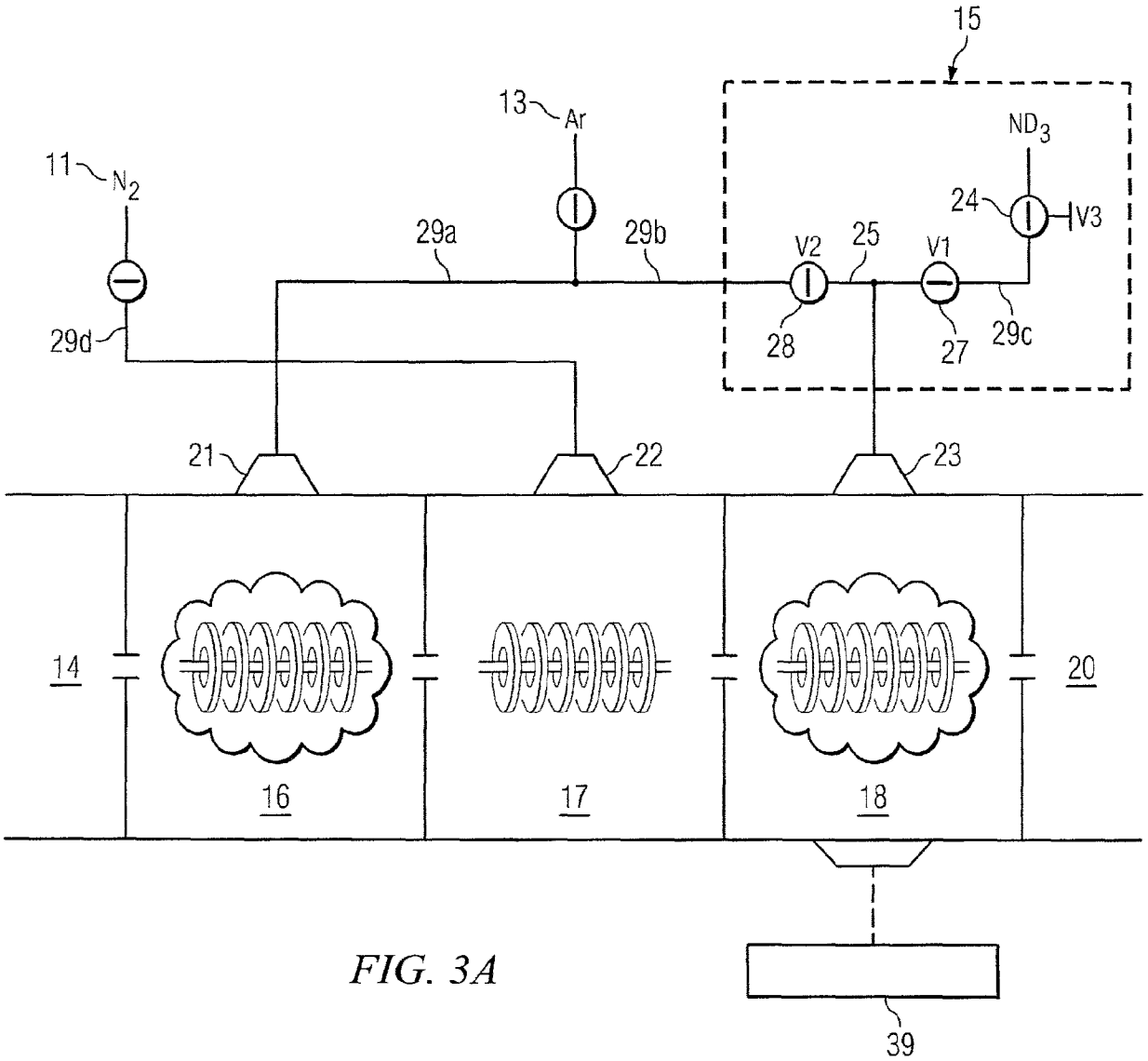
FIG. 3A shows a diagrammatic view of gas inlet modifications to a mass spectrometer in accordance with the present invention when ion mobility separation is not performed.
Figure 3B:
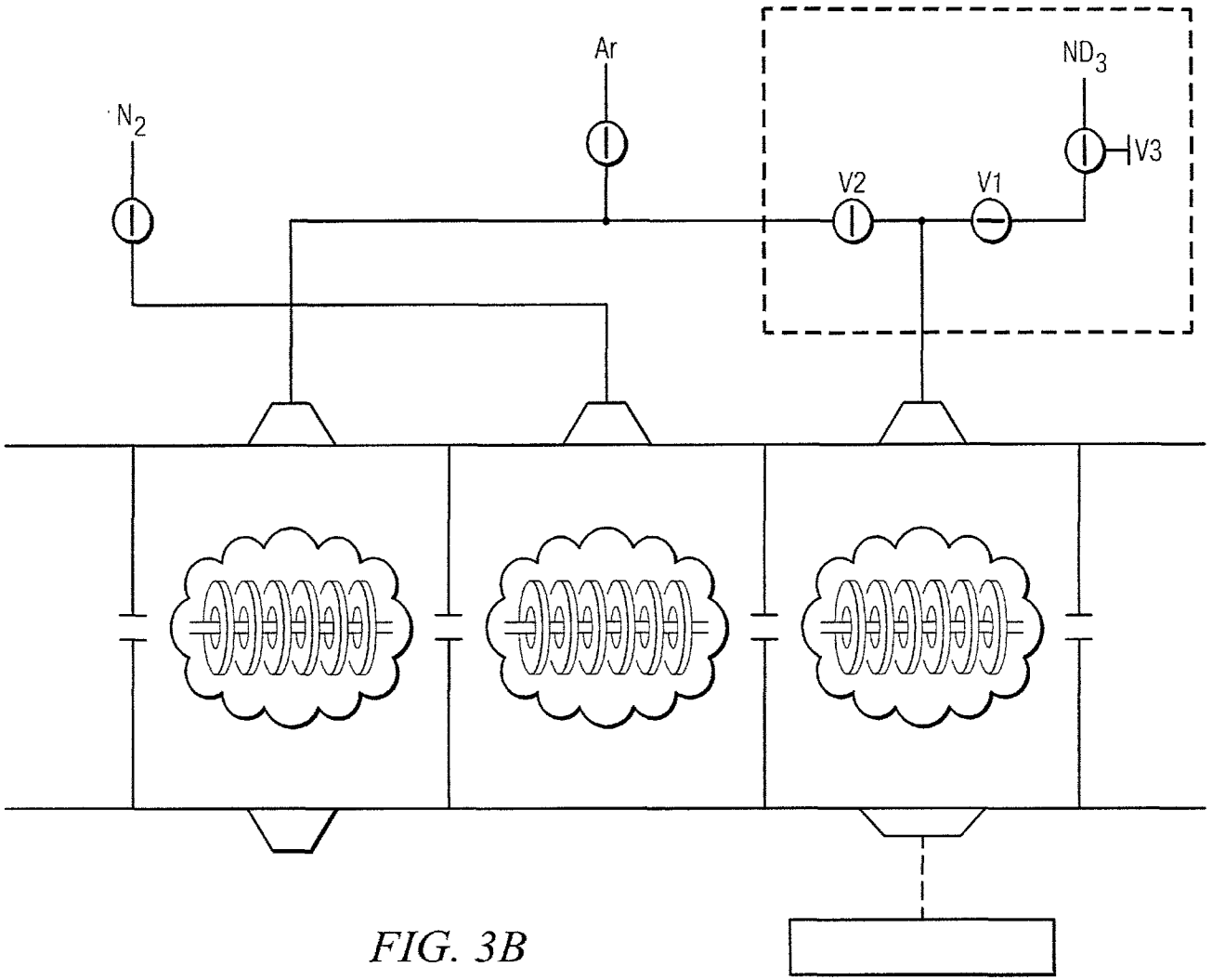
FIG. 3B shows a diagrammatic view of gas inlet modifications to a mass spectrometer in accordance with the present invention when ion mobility separation is performed in tandem with isotopic labeling.

Referring to FIG. 1, FIG. 3A, and FIG. 3B, operation of an MS 10 having a gas-phase HDX capability will now be described. Although gas-phase HDX can be carried out in the source-TWIG 12, the trap-TWIG 16, the mobility-TWIG 17 or in multiple TWIGs, operation will be described herein assuming that gas-phase HDX takes place in the transfer-TWIG 18 of a Synapt™ MS 10, in which the transfer-TWIG 18 is disposed between the mobility-TWIG 17 and the TOF detector 20.

The improvement to the Synapt™ MS 10, includes conduit or tubing 29*a* to provide a gas connection between a gas inlet 21 disposed on the trap-TWIG 16 and an external gas source 13, e.g., an argon gas source, and conduit or tubing 29*b* to provide a gas connection between a gas inlet 23 disposed on the transfer-TWIG 18 and the external gas source 13. The gas inlet disposed on the mobility-TWIG 17 of the Synapt™ MS 10 is already coupled to a bath gas source 11, e.g., nitrogen ($N_2$).

The conduit or tubing 29*b* to transfer-TWIG 18 is further modified to include a fluid connection between the gas inlet 23 and a deuterium gas labeling source 15, e.g., $ND_3$ gas. Although usable, weaker reagent bases such as $D_2O$ and $CH_3OD$ may not label peptide and proteins to significant extents during the short time-scales that are employed using $ND_3$. Indeed, evidence presented here and by others suggests that the deuterium incorporation of proteins in $ND_3$ gas 15 is more directly correlated to surface accessibility and conformation due to the exchange mechanism employed by the $ND_3$ gas 15. Further, $ND_3$ gas is used as a deuterium gas labeling source for these labeling experiments because it is a strong reagent base. By performing gas-phase HDX in the transfer-TWIG 18 in a curtain of highly-reactive, deuterated gas that surrounds the plurality of electrodes 30 and permeates into the center annular region 35 of the ion guide, protein ions are primarily deuterium labeled at surface accessible facile sites.

The gas coupling further includes a splitting T-connection 25 with switching valves 27 and 28 disposed upstream and on either side of the splitting T-connection 25 and the downstream end that is fluidly coupled to the gas inlet 23. An additional needle valve 24, e.g., a needle valve manufactured by Meggitt Avionics of Hampshire, UK, can be used for gradual, controlled infusion of $ND_3$ gas 15 into the transfer-TWIG 18 or the source-TWIG 12. All gas-tubing can be stainless steel and connections can be made using, for example, ⅛-in. fittings manufactured by Swagelok of Billerica, Mass. Preferably, the valves 27, 28 are two-way switching valves such as a model Whitey SS-41S2 valve also manufactured by Swagelok, Billerica, Mass. Although not shown, gas couplings and valves can also be provided to supply the $ND_3$ gas 15 to the source-TWIG 12, the mobility-TWIG 17, and any other TWIG that is incorporated into the MS 10.

At sub-millisecond timescales and relatively high pressures of $ND_3$ gas 15, all exchangable sites on the ion are probed continuously due to the high frequency of ion-molecule collisions; however, only facile sites have sufficient time to exchange. Sites for slower exchanging, such as backbone amide hydrogen ions, do not appear to exchange significantly during the same time-frame. The extent of HDX depends on the abundance of exchange-competent $ND_3$-protein ion complexes formed per unit time, i.e., reaction parameters and protein charge state, and, moreover, on the accessibility of bound $ND_3$ molecules to facile exchangable sites in the protein, i.e. surface accessibility, intramolecular hydrogen bonding, and so forth.

By placing the first valve 27 in the "open" position (as shown in FIG. 3A and FIG. 3B) and the second valve 28 in the "closed" position (as shown in FIG. 3A and FIG. 3B), an operator can use the needle valve 24 to control the flow rate and gas pressure, e.g., between 1 and 12 psi, of the infusion of $ND_3$ gas 15. Optionally, when both valves 27 and 28 are opened, the operator can use the needle valve 24 to control the flow rate and gas pressure of the $ND_3$ gas 15 infused into both the trap-TWIG 16 and into the transfer-TWIG 18. Although not shown, Optionally, a pressure gauge 39 can be fitted onto the Synapt™ tri-wave enclosure 26 near the transfer-TWIG 18. The optional pressure gauge 39 facilitates measurement of pressure in the transfer-TWIG 18. $ND_3$ pressures can be determined by subtracting the default background pressure in the transfer-TWIG 18 in the absence of $ND_3$ gas 15 from the pressure after infusion of $ND_3$ gas 15.

For experiments in which gas-phase HDX labeling is desired to be performed in the source-TWIG 12, the first valve 27 is opened and second valve 28 is closed. Moreover, the connector tubing 29*c* between the first valve 27 and the needle valve 24 can be disconnected from the first valve 27 and re-connected to the gas-inlet (not shown) of the source-TWIG 12. Here again, the needle valve 24 can control the flow rate and gas pressure of the $ND_3$ gas 15 infused into the source-TWIG 12.

Gas-Phase HDX Experiments

Mass Spectrometry

For each of the experiments conducted and described below, positive electrospray ionization (ESI) mass spectrometry was performed using a Synapt™ HDMS mass spectrometer manufactured by Waters Corporation of Milford, Mass. The ESI source was operated with a capillary voltage of 3.5 kV, a sampling cone voltage of 45V, a source-block temperature of 100° C., and a desolvation temperature of 250° C.

When ion mobility separation is performed in tandem with gas-phase HDX ("Mode 2"), the collision energy in the quadrupole 14 was set to 4V. Mass accuracy was ensured by external calibration in MS/MS mode with 100 fmol/mL Glu-fibrinopeptide B. Mass spectra were acquired over an m/z range of 100 to 2000.

Wave Height

As previously mentioned, the wave height of the T-wave controls whether protein ions 33 are retained in the potential wells 31 of the (voltage) potential wave or, alternatively, roll-over the sides of the potential wave into the potential well 31 of a following potential wave. Ion roll-over causes mobility separation of ions according to ion shape and charge, which is fine in the mobility-TWIG 17. Ion roll-over, however, is not desired during HDX in a TWIG because, when there is roll-over, the labeling time is no longer equal to the transit time of a single T-wave through the TWIG; but, rather, becomes a function of properties of each ion, e.g., shape, the m/z of individual ions, and so forth.

Accordingly, to ensure that all protein ions are retained in the potential wells 31 of the traveling wave and do not roll-over, a sufficiently high wave height, e.g., a potential difference of 3-6V, was used. Referring back to FIG. 2C, at a constant $ND_3$ pressure of $3\times10^{-3}$ mbar in the transfer-TWIG 18, deuterium uptake of ubiquitin ions remained constant or substantially constant at wave heights from 6V to 1V. However, a sudden and substantial increase in the observed deuterium uptake of ubiquitin ions was observed after decreasing the wave height to 0.2V. More specifically, a wave height of 0.2V was no longer sufficient to carry the ubiquitin ions in potential wells 31 of the T-wave, causing a significantly slower transport through the transfer-TWIG 18 and, hence, longer labeling times.

Control experiments conducted on other proteins and at various gas pressures in the transfer-TWIG 18 indicated that in all cases a wave height of 3-6V in the transfer-TWIG 18 was sufficient to retain ions 33 in the potential well 31 of the T-wave. Accordingly, by using a wave height of 3-6V, one ensures that all peptide or protein ions from the same sample are exposed to $ND_3$ gas for equal times, irrespective of differences in ion collisional cross section and m/z ratio. Although a wave height between about 3V and 6V is used in the TWIGs with satisfactory results and a wave height of about 0.2V is used in the mobility-TWIG 17, the invention can be practiced using wave heights as low as about 0.1V and as high as about 20V.

Notwithstanding, the use of greatly elevated potentials in the transfer-TWIG 18 in the presence of high-pressure background gas can cause substantial collisional activation and dissociation of analyte ions. For example, Glu-fibrinopeptide B (GFP) has been observed by the inventors and by others to undergo fragmentation in a TWIG at wave velocities that exceed 1000 m/s and a wave height of 8V in the presence of Argon gas at $5\times10^{-3}$ mbar.

The experimental conditions and pressures of $ND_3$ gas at which the transfer-TWIG 18 was operated during gas-phase HDX experiment in the present study, viz., wave velocities of 50-300 m/s, wave height of 3-6V, minimal TWIG collision and injection voltages, and a curtain $ND_3$ gas pressure below $8\times10^{-3}$ mbar, were well below the observed threshold for fragmentation. This is supported by FIG. 2C, which shows that the deuterium uptake of ubiquitin ions was unaffected by increases in the wave height from 1V to 6V and even up to 15V (not shown). The multiple peak shapes occurring for individual charge states of apo-myoglobin upon gas-phase HDX (not shown) were similarly unaffected by an increase of the transfer-TWIG 18 from 4V to 15V.

Finally, ESI of myoglobin in deionized water at the conditions used for gas-phase HDX experiments resulted in charge states only of the folded holo-form of the protein, indicating minimal activation of analyte ions at the conditions used herein. Taken together, these findings suggest that the gas-phase HDX experiments at a voltage potential of 3V to 6V were performed in a soft collisional regime where the internal energies of analyte ions were below the energy threshold required for structural unfolding/isomerization. At such gentle conditions, the exchange rate is limited by the frequency of formation of exchange competent ion-molecule complexes and not by unintentional activation of ions.

Sample Preparation

All proteins and peptides were purchased from Sigma Aldrich of St. Louis, Mo. and were used without further purification.

Lyophilized peptides were dissolved in water and diluted into 50% acetonitrile, 0.1% formic acid to 3 μM (Leucine Enkephalin), 0.5 μM (Glu-fibrinopeptide B) and 2.5 μM (Bradykinin). Equine cytochrome C was dissolved in water (290 μM) and diluted to 2 μM in 50% acetonitrile containing 0.2% acetic acid (pH 2.8).

Lysozyme from chicken egg white was dissolved in water (300 μM) and either diluted directly to 60 μM in 1 mM ammonium acetate, pH 6.5 (disulfide-intact form) or, alternatively, diluted to 60 μM in 20 mM TCEP, pH 2.5, and incubated at 90° C. for 5 minutes (disulfide-reduced form). Lysozyme samples were infused immediately into the mass spectrometer after preparation at a rate of 5 μl/min via the auxiliary sample pump of the Synapt™ HDMS.

Bovine ubiquitin was dissolved in water (39 μM) and diluted into 50% acetonitrile containing 0.1% formic acid (pH 2.3) to a concentration of 4.2 μM.

Equine myoglobin was dissolved in water (200 μM) and diluted to 20 μM in 50% acetonitrile containing 0.1% formic acid (pH 2.3).

Prior to electrospray, protein solutions were occasionally mixed 1:1 with a solution of 3 μM Glu-fibrinopeptide B. Because deuterium uptake as a function of $ND_3$ pressure was determined for Glu-fibrinopeptide B (GFP) in a separate experiment, the peptide served as an internal reporter of gas-phase HDX when it was present in mixtures containing other peptides/proteins. Accordingly, a given deuterium uptake observed for GFP in mixtures could be correlated with a known $ND_3$ pressure in the transfer-TWIG when GFP was labelled by itself under conditions where the precise $ND_3$ pressure was well characterized.

Experimentation

Mode 1 HDX experiments that include curtain labeling without ion mobility separation were performed using the default TOF-MS setting of the instrument 10, with a T-wave velocity of 300 m/s in each of the source-TWIG 12, trap-TWIG 16, ion mobility-TWIG 17, and transfer-TWIG 18; T-wave heights of 3V in the source-TWIG 12, trap-TWIG 16, and mobility-TWIG 17; and a T-wave height of 6V in the transfer-TWIG 18. At these conditions, gaseous protein and peptide ions produced at the ion source 19 reach the transfer-TWIG in approximately 1.2 msec (for source-TWIG, trap-TWIG, and mobility-TWIG lengths of 10 cm, 10 cm, and 18.7 cm, respectively).

Argon gas 13 flow to the trap-TWIG 16 was fixed at 1.5 mL/min while the rate and pressure of $ND_3$ gas flow 15 to the transfer-TWIG 18 was controlled and varied. The equilibration time between changing $ND_3$ pressures in the transfer-TWIG 18 was less than five (5) seconds. Advantageously, numerous gas-phase HDX experiments could be performed on the same continually infused sample, enabling real-time measurement of deuterium uptake as a function of reagent gas pressure, wave speed or various other TWIG parameters.

A limited number of Mode 2 experiments that include curtain labeling in tandem immediately after ion mobility separation were performed using the default ion mobility settings of the MS 10. Ions accumulated in the trap-TWIG 16 were released into the mobility-TWIG 17 during each mobility separation cycle over a period of 64 msec. The mobility-TWIG bath gas 11, e.g., nitrogen, flow was set to 24 mL/min. The mobility T-wave parameters were varied for maximal mobility separation but using fixed T-wave parameters for the source-TWIG 12 and for the trap-TWIG 16, i.e., T-wave height: 3V and T-wave velocity: 300 m/s, and for the transfer-TWIG 18, i.e., T-wave height: 6V and T-wave velocity: 300 m/s).

Analyte ions 33 were transported by the potential wells 31 of the T-wave in transfer-TWIG 18 and labeled at $ND_3$ gas 15 pressures of between 0.1 mbar and $9\times10^{-3}$ mbar. The corresponding pressures in the time-of-flight (TOF) detector 20 ranged between $3\times10^{-7}$ mbar and $1.4\times10^{-6}$ mbar. It was noted that a further increase of $ND_3$ gas pressure beyond $9\times10^{-3}$ mbar caused a rapid decline in the performance of the TOF detector 20. Background pressure in the transfer-TWIG 18 was $0.1\times10^{-3}$ mbar in the absence of $ND_3$ gas 15.

The residence time of analyte ions in the transfer-TWIG 18, i.e., the labeling time, was controlled by changing the speed of the transfer T-wave. By changing transfer T-wave speeds from 900 m/sec to 10 m/sec, labeling times of 0.1 msec and 10 msec, respectively, could be achieved (for a transfer-TWIG 18 having a length of 10 cm).

Gas-phase HDX experiments in the source-TWIG 12 used T-wave settings similar to those used for the transfer-TWIG 18. Source-TWIG 12 labeling experiments could be performed at significantly higher $ND_3$ gas pressures, e.g., $0.1\times10^{-3}$ mbar to $1\times10^{-1}$ mbar, due to the remote location of the source-TWIG 12 from the TOF detector 20.

Mass spectra were processed with MassLynx software developed by Waters Corporation of Milford, Mass. and mass lists were exported to Excel, developed by MICROSOFT of Redmond, Wash. Gas-phase deuterium uptake of peptides and proteins was calculated from intensity-weighted average masses of deuterium labeled ions relative to the corresponding masses of non-labeled ions measured in the absence of $ND_3$ gas. Replicate labeling experiments on ubiquitin at an $ND_3$ pressure of $0.8\times10^{-3}$ mbar indicated a standard deviation of 1 Da (n=3) in the measurement of the mass of deuterated species. Mobility data were processed in the Driftscope module of the MassLynx software package.

Gas-Phase HDX of Model Peptides

During a first set of tests, a variety of protonated polypeptide ions were deuterium labeled in the transfer-TWIG 18 at various $ND_3$ pressures, viz., between 0.1 mbar and $9\times10^{-3}$ mbar. A summary of results of the testing is provided in graph form in FIG. 4A. The results demonstrate that increasing the pressure of the $ND_3$ gas pressure results in an immediate and sharp increase in the deuterium uptake of peptide ions upon infusion of Leucine enkephalin ("Leu-Enk", seq.:YGGFL), Glu-fibrinopeptide B ("GFP", seq.: EGVNDNEEGFFSAR) and Bradykinin ("BK", seq.: RPPGFSPFR). However, at higher reagent gas pressures, the number of collisions between deuterated gas-molecules and analyte ions in the T-wave increases as the analyte ions travel through the reagent curtain gas in the transfer-TWIG 18. Increased ion-neutral collisions slow down the analyte ions, which increases the likelihood of formation of stable exchange-competent ion-neutral complexes.

By increasing the $ND_3$ gas pressure in the transfer-TWIG 18, singly-charged Leu-Enk peptides readily incorporated five (5) deuterium ions (to a maximum of six at the highest pressure), while singly-charged BK did not exchange any of its 18 theoretically labile hydrogen ions. Singly-charged BK fails to exchange due to the sequestering of the single charge at the Arg side-chain, making the proton unavailable to initiate exchange. These results are in good agreement with previous gas-phase HDX studies on similar model peptides using $ND_3$ gas.

Notably, the addition of another proton to BK can cause the doubly-charged BK to exchange up to five (5) hydrogen ions, in striking contrast to the singly-charged counterpart. A similar difference in gas-phase HDX could also be observed for singly-versus doubly-charged GFP.

In a prior study, the gas-phase HDX of Leu-Enk was fully accounted for by five (5) fast exchanging sites corresponding to hydrogen ions attached to the side-chains, viz., the protonated N-terminal amino-group, the hydroxyl group of the Tyr side-chain, and the C-terminal carboxy-group, and by four (4) slower exchanging sites corresponding to the backbone amide hydrogen ions. Based on this classification of exchangeable sites in Leu-Enk, primarily fast-exchanging sites on the side-chains are deuterium labeled in the transfer-TWIG 18 presumably due to the very short exchange times employed. Moreover, at maximal $ND_3$ pressure, exchange of a single amide hydrogen in Leu-Enk can occur. Due to proximity effects this could preferentially be the N-terminal amide hydrogen in Leu-Enk as the charge on the N-terminal amino-group would enhance exchange of this particular amide.

Figure 4A:
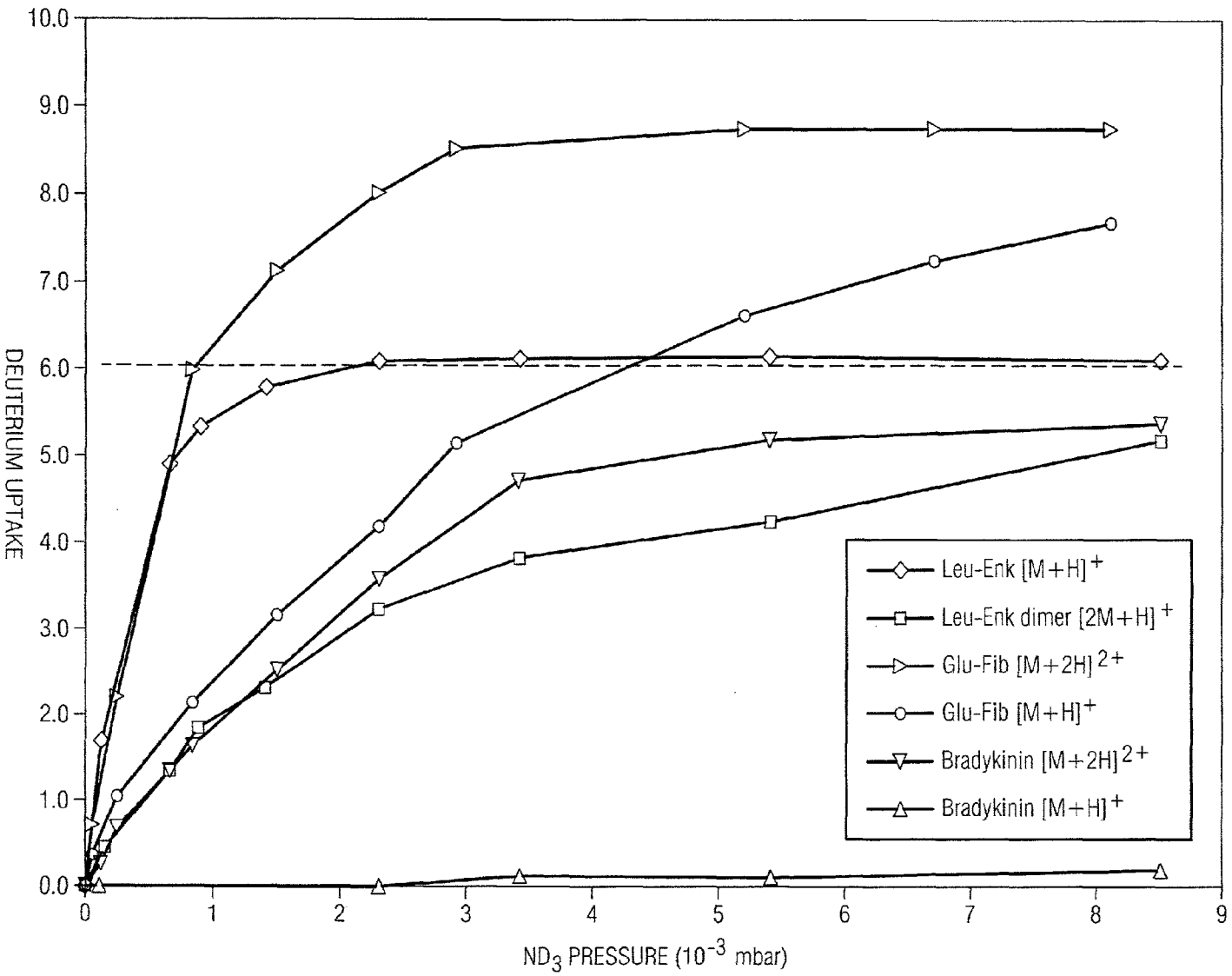
FIG. 4A shows a graphical summary of deuterium uptake as a function of increasing pressure of the $ND_3$ gas for various peptides.
Figure 4B:
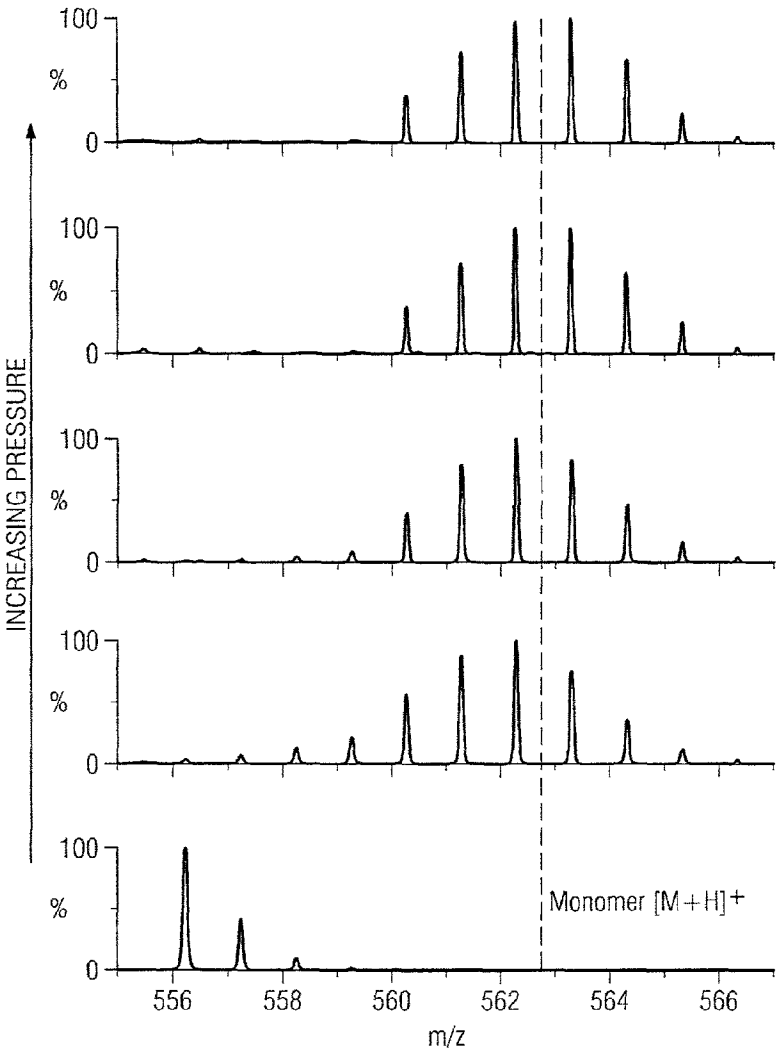
FIG. 4B shows mass spectra at various labeling gas pressures for a singly-charged monomer of leucine enkephalin peptide.
Figure 4C:
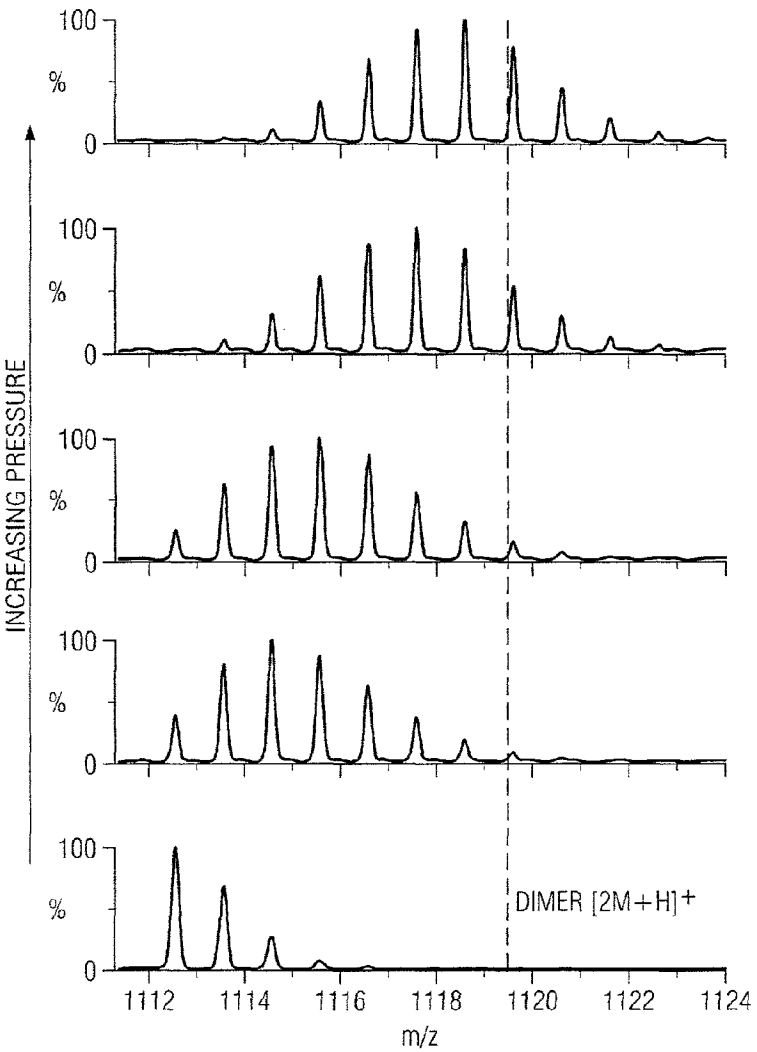
FIG. 4C shows mass spectra at various labeling gas pressures for a doubly-charged homodimer of leucine enkephalin peptide.

Referring to FIGS. 4B and 4C, at the employed ESI conditions, mass spectra reveal that the Leu-Enk peptide exists as both a monomer (FIG. 4B) and as a non-covalent homodimer (FIG. 4C) in the gas phase. The singly-charged, non-covalent Leu-Enk homodimer ("dimer") exchanged significantly less at increasing pressures than the corresponding Leu-Enk monomer. Indeed, the "dimer" exchanged no more than five (5) deuterium ions even at maximal $ND_3$ gas pressures, indicating that several exchangeable sites on Leu-Enk were protected from exchange in the complex. This suggests that steric shielding and conformational constraints significantly influence deuterium labeling of gas-phase polypeptides in the transfer-TWIG 18. Indeed, steric shielding of facile sites due to complex formation or protein conformation will give rise to changed deuterium uptake.

Charge Stripping

The predominant reaction pathway of $ND_3$ gas with protonated polypeptides is exchange of labile hydrogen ions between sites of similar gas-phase basicity. A minor degree of proton-transfer reactions, i.e., stripping of charge from multiply protonated protein ions, were observed at elevated $ND_3$ gas pressures greater than $5\times10^{-3}$ mbar. A similar effect was observed upon maximal exposure of protein ions to the deuterated gas, i.e., a minimal T-wave velocity of 10 m/sec.

Because the confluence of both gas-phase reactions could confound interpretation of exchange data, the extent of charge-stripping occurring prior to TOF detection can be determined by performing control experiments in which individual charge states of ubiquitin and apo-myoglobin are isolated in the quadrupole prior to gas-phase reactions in the transfer-TWIG 18. As a result, occurrence of proton-transfer reactions in a given experiment can be monitored by the emergence of charge-reduced peaks, e.g., z-1, z-2, z-3, etc., of the isolated protein ion in the resulting spectrum.

Measurements of proton-transfer reactions occurring in the transfer-TWIG 18 with reagent bases such as ammonia could inherently provide an additional avenue for conformational detection using the present invention. However, although significant charge stripping by the $ND_3$ gas could be induced at defined conditions discussed above, such stripping did not occur significant levels in HDX experiments reported herein due the fact that the labeling times were very short and the pressure of reactant base ($ND_3$) was too low.

Gas-Phase HDX of Proteins

Figure 5A:
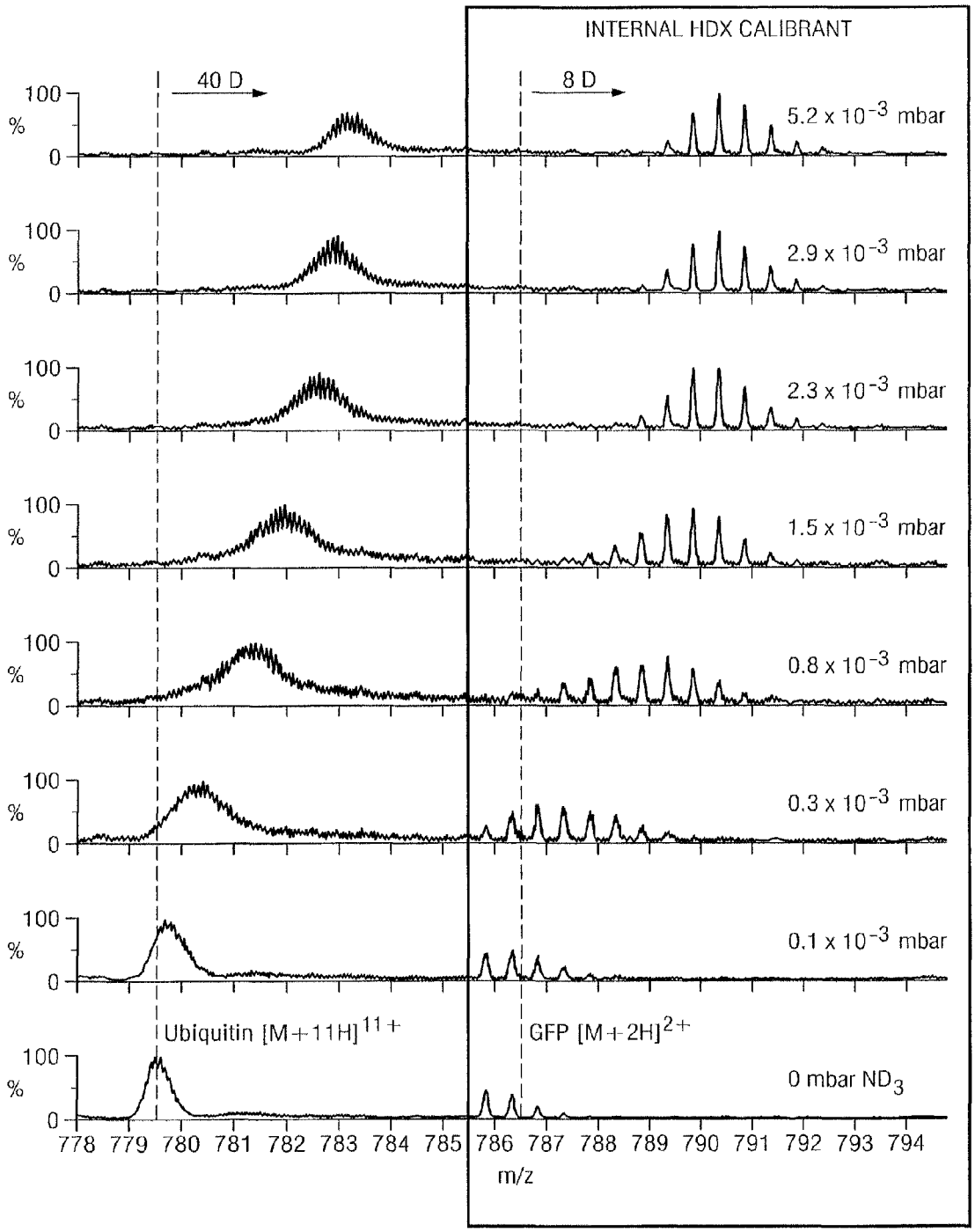
FIG. 5A shows the effect of gas pressure on mass spectra for ubiquitin and Glu-fibrinopeptide B ions.

In a second set of experiments, gas-phase HDX reactions with $ND_3$ gas infused into the transfer-TWIG 18 were extended to proteins. Mass spectra acquired at gradually increasing pressures of $ND_3$ gas upon infusion of a mixture of ubiquitin and GFP in 50% acetonitrile and 0.1% formic acid are shown in FIG. 5A. Ubiquitin ions displayed considerable deuterium labeling in the transfer-TWIG 18, with the ubiquitin $[M+11H]^{11+}$ ion exchanging up to 40 deuterium (40 D) ions at maximal $ND_3$ pressure using the default T-wave velocity (300 m/sec). This corresponds to exchange of 50% of all labile side-chain hydrogen ions or 25% of all labile hydrogen ions in ubiquitin within the 0.33 msec during which the ions were exposed to the $ND_3$ curtain in the transfer-TWIG 18 (length approximately 10 cm). The GFP $[M+2H]^{2+}$ ion exchanged up to 8 deuterium (8 D) ions at maximal $ND_3$ pressure using the default T-wave velocity (300 m/sec).

Figure 5B:
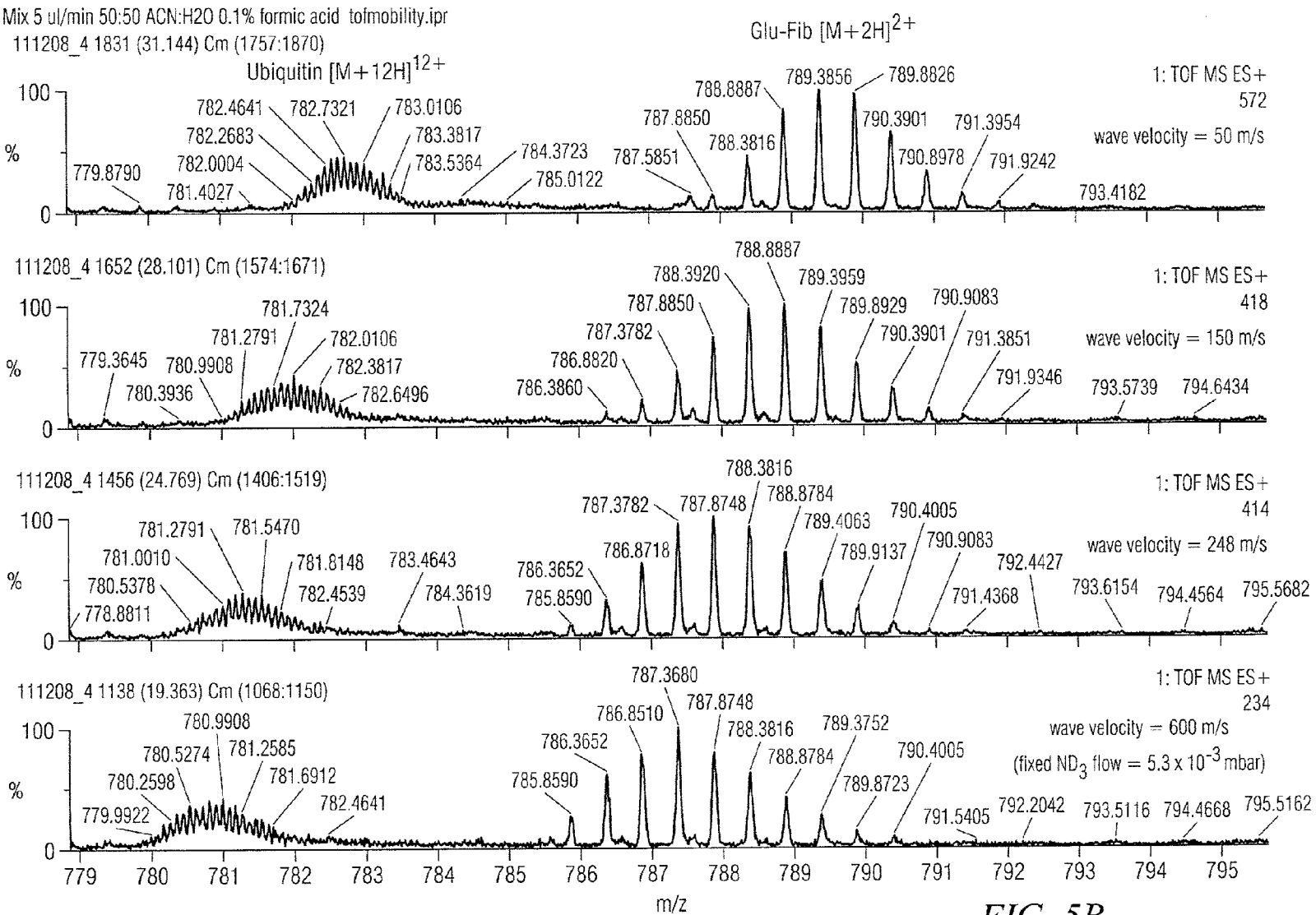
FIG. 5B shows the effect of wave velocity on mass spectra for ubiquitin and Glu-fibrinopeptide B ions.

The residence time of analyte ions in the TWIG, i.e., the labeling time, can be precisely controlled. Changing T-wave speeds from 900 m/sec to 10 m/sec resulted in labeling times from 0.1 msec and 10 msec, respectively. The effect of wave velocity on deuterium uptake of ubiquitin and GFP at a fixed pressure of $ND_3$ is shown in FIG. 5B. As the T-wave travels faster, there is less time for labeling and therefore less deuterium is exchanged in both peptide and protein ions.

FIG. 5A illustrates that co-infusion of a small peptide such as GFP can provide an internal labeling standard or calibrant that gauges the efficiency of HDX in the transfer-TWIG 18. Such a simple internal calibrant can be used to correlate independent measurements on different protein samples as an alternative to measuring the pressure of $ND_3$ gas 15 via the pressure gauge 39 presently fitted to the transfer-TWIG 18. In this way, one could also obtain identical conditions in different instruments independent of a pressure measurement or flow rate of $ND_3$ by monitoring the amount of deuterium found in the GFP standard under identical instrumental parameters.

Sequential (in Tandem) Ion Mobility Spectrometry and Gas-Phase HDX

The work of others has demonstrated that the infusion of small amounts of $D_2O$ gas into the drift-tube of a custom-made ion mobility spectrometry instrument allows deuterium labeling of protein ions, which are simultaneously undergoing mobility separation in a He bath-gas within the drift-tube. Ion mobility separation and "curtain" labeling occurring simultaneously present some complications with regard to data analysis because labeling times vary with the drift-times of different ions. Moreover, ion mobility separation changes with the pressure of $D_2O$ gas in the drift-tube.

Accordingly, ion mobility separation was performed in the mobility-TWIG 17, and a chemical reaction, i.e., the HDX, was performed in the adjacent, downstream transfer-TWIG 18. In operation, analyte ions are propelled by the T-wave through the mobility-TWIG 17 that contains a $N_2$ background (bath) gas 11 at a relatively high pressure, e.g., 0.1 mbar, to separate ions according to collisional cross-section.

Figure 6A:
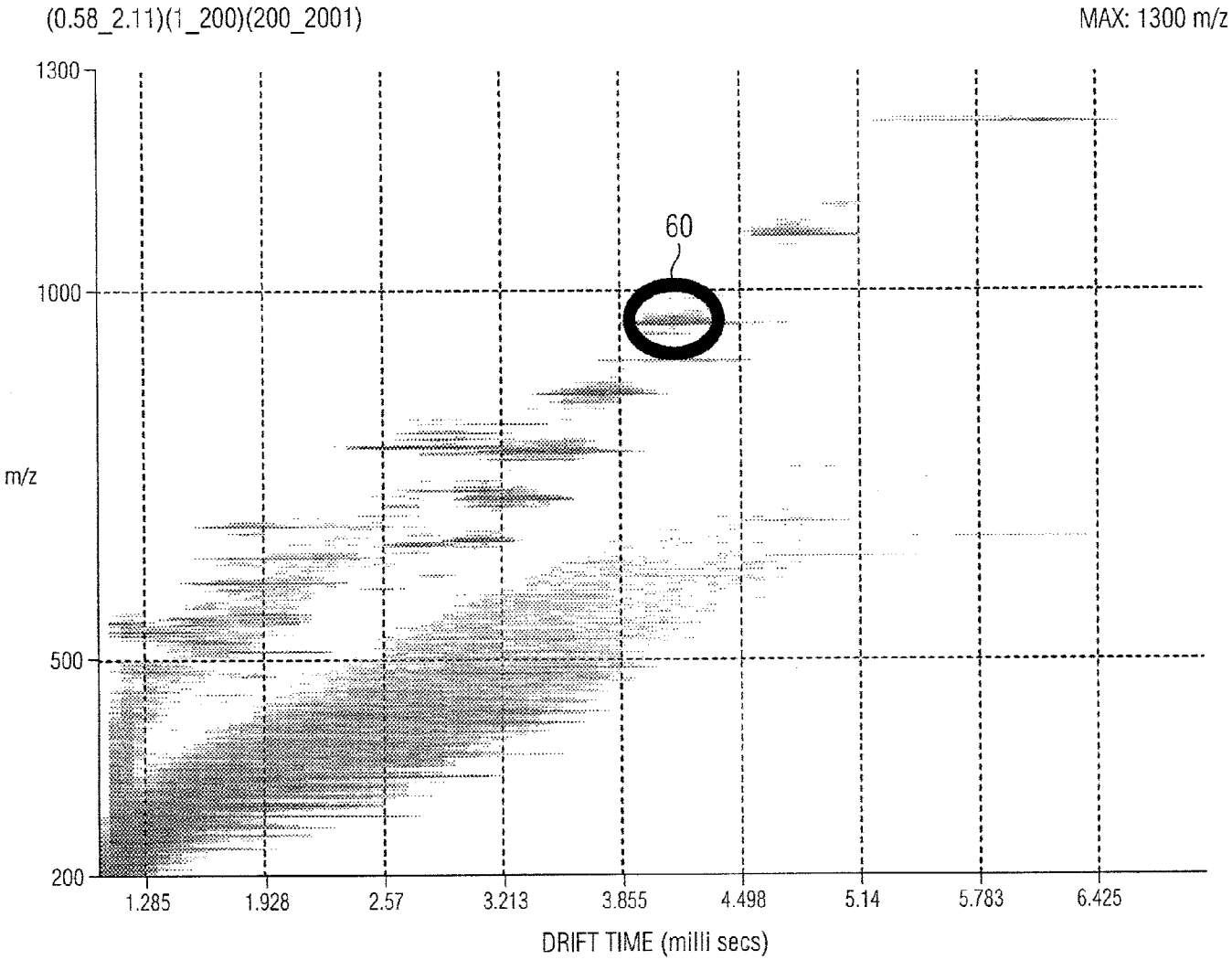
FIG. 6A shows an ion mobility drift-time chromatogram of the $[M+8H]^{8+}$ ion of ubiquitin in the absence of a labeling gas in the transfer TWIG.

Subsequently, the temporally-separated ions are transported through the adjacent transfer-TWIG 18 in which a cloud or "curtain" of lower pressure $ND_3$ gas is infused. The cloud or "curtain" isotopically labels analyte ions in a sub-millisecond time-frame. For example, ion mobility drift-time chromatography and corresponding mass spectra for a mixture of ubiquitin and GFP are shown, respectively, in FIGS. 6A and 6B for the case without $ND_3$ gas in the transfer-TWIG 18 and FIGS. 6C and 6D for the case with $ND_3$ gas in the transfer-TWIG 18. FIGS. 6A and 6C show a plan view of the ion mobility separation. A comparison of the figures shows that the drift-times of the ions in the conformation of interest 60 in the mobility-TWIG 17 are unaffected by the presence of $ND_3$ gas in the transfer-TWIG 18. Thus, both the collisional cross-section and the exchange reactivity of analyte ions can be measured in a single data acquisition.

Figure 6B:
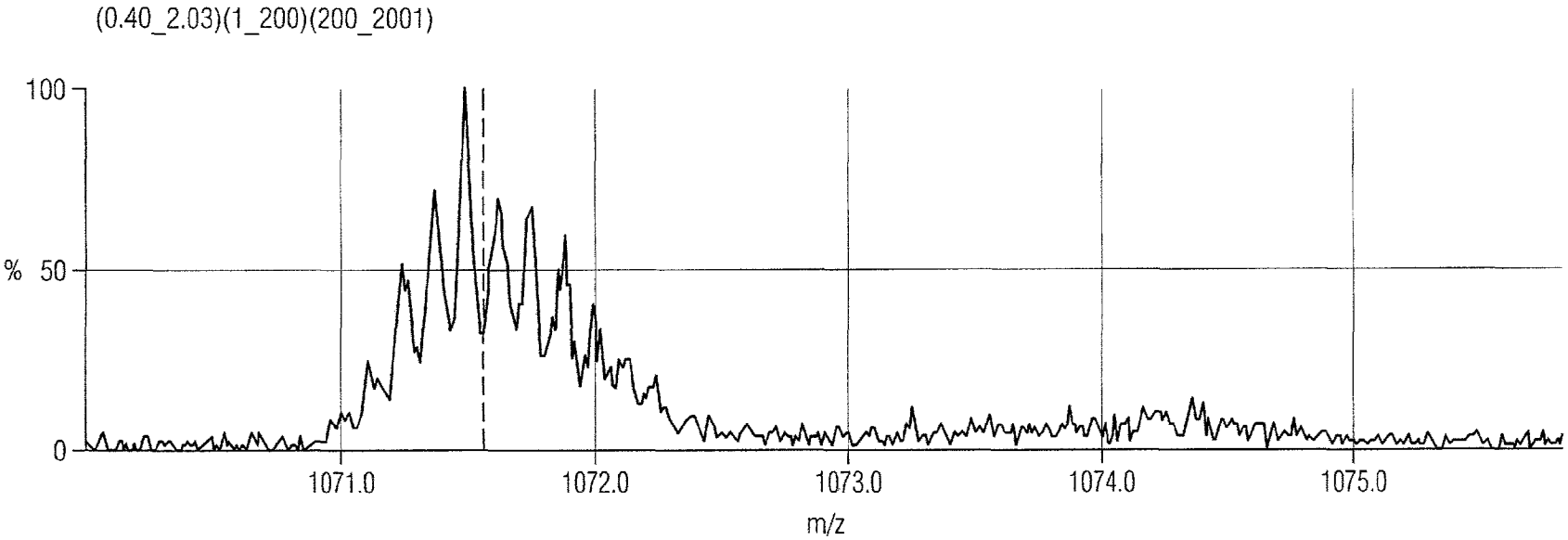
FIG. 6B shows mass spectra of the ion in FIG. 6A.
Figure 6C:
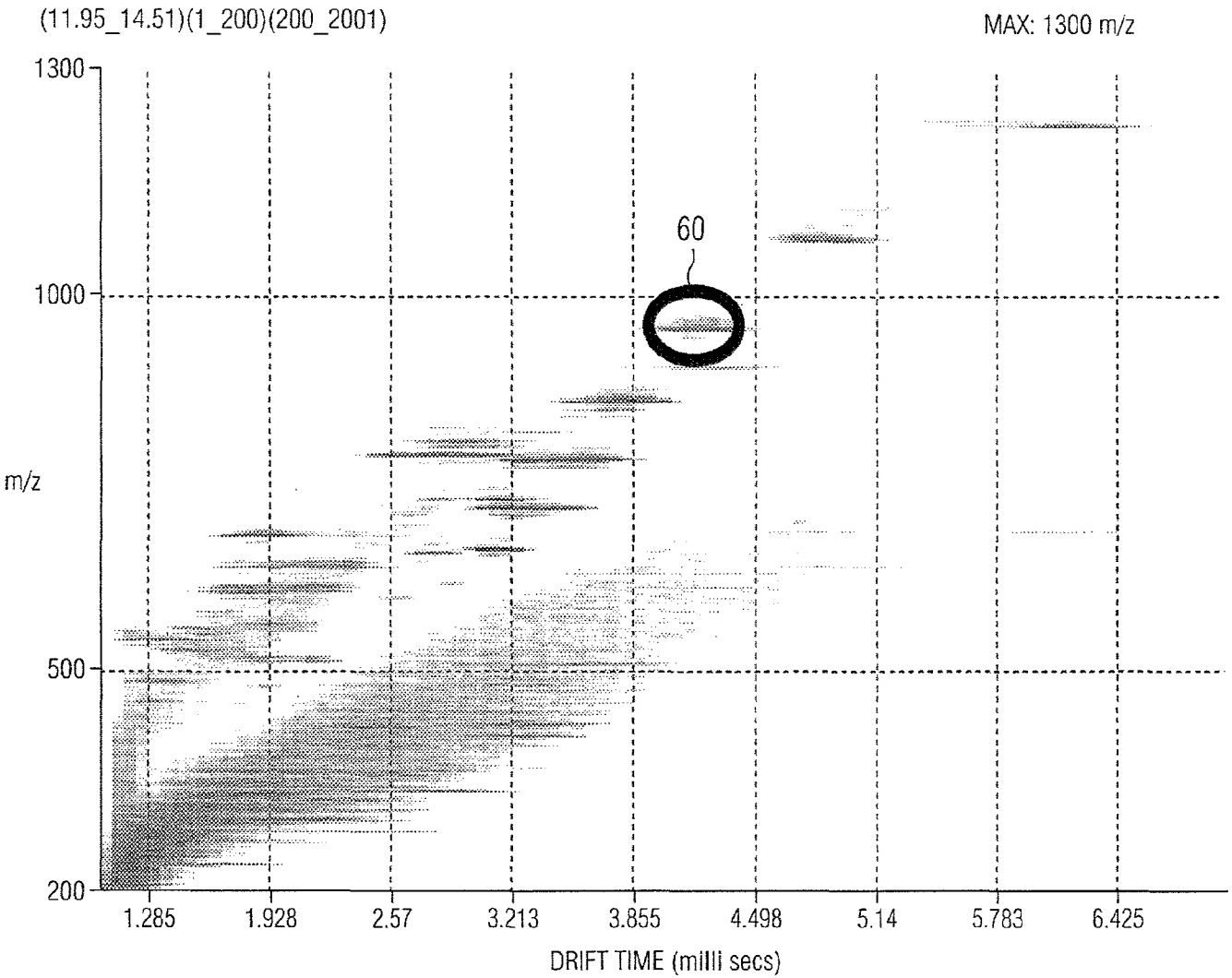
FIG. 6C shows an ion mobility drift-time chromatogram of the $[M+8H]^{8+}$ ion of ubiquitin in the presence of a labeling gas in the transfer TWIG.
Figure 6D:
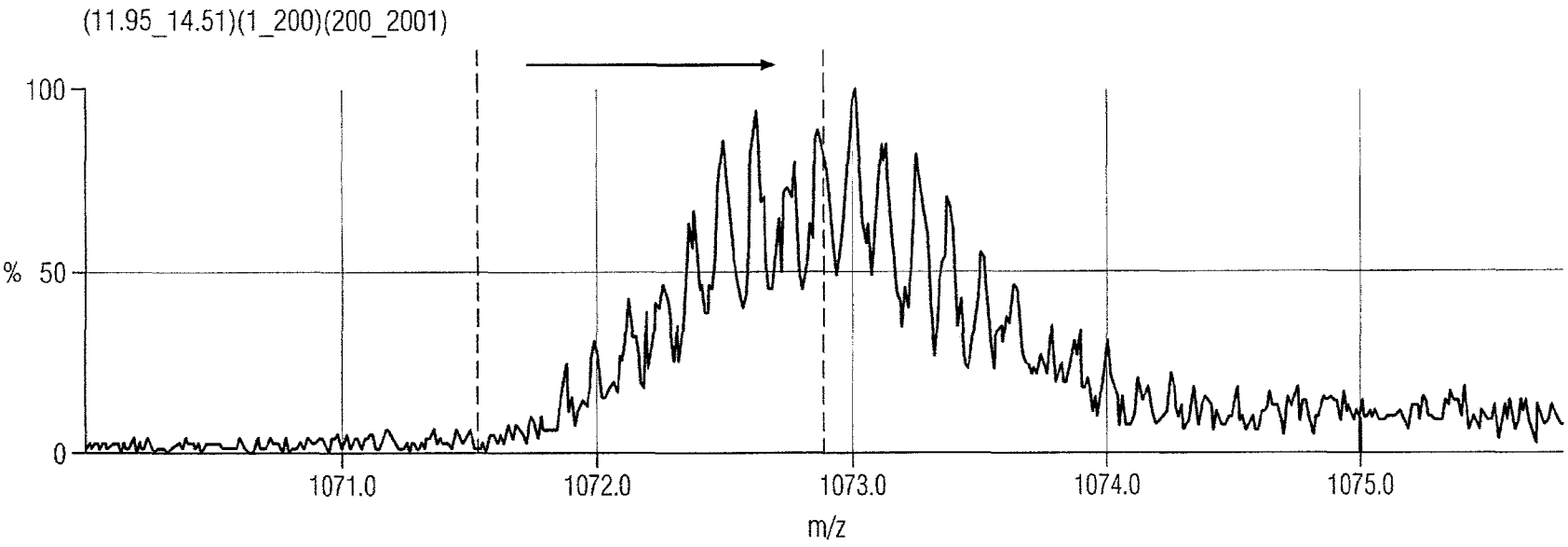
FIG. 6D shows mass spectra of the ion in FIG. 6C.

FIGS. 6B and 6D, on the other hand, demonstrate the additional advantages, i.e., a second dimension orthogonal to the ion mobility drift dimension, of a subsequent HDX reaction through a curtain of $ND_3$ gas. The spectra shown here serve to indicate the general versatility of the TWIG for gas-phase studies of proteins and how analytical approaches based on ion mobility or gas-phase reactivity can be compartmentalized in the same instrument by TWIGs placed in tandem.

Gas-Phase HDX in the Source-TWIG

Figure 7:
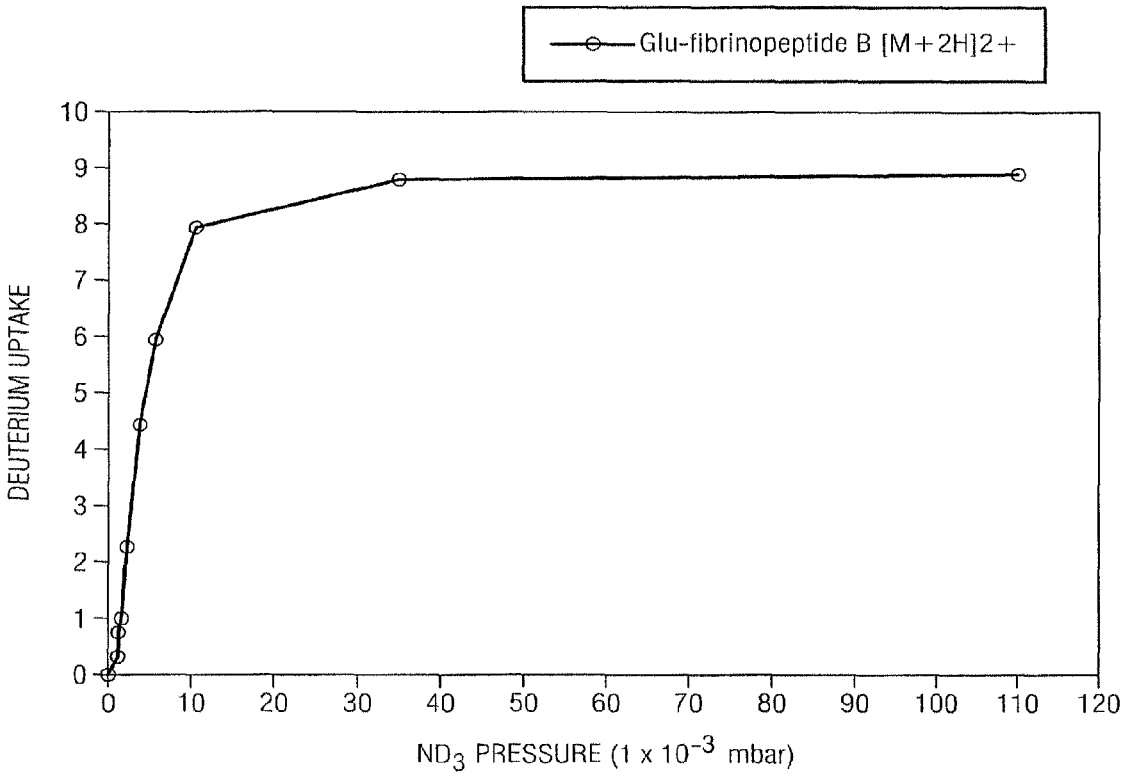
FIG. 7 shows a graph summarizing the effect of pressure on deuterium uptake for HDX reactions taking place in a source-TWIG.

In a limited number of related experiments, the gas inlets were reconfigured to infuse $ND_3$ gas into the source-TWIG 12 rather than into the transfer-TWIG 18. The source-TWIG 12 is adapted to provide similar control of reaction parameters, i.e., labeling times, labeling pressure, wave speed, and the like. In comparison with the results from the transfer-TWIG 18, relatively higher pressures of $ND_3$ gas, e.g., greater than $9\times10^{-3}$ mbar, in the source-TWIG 12 did not affect the performance of the TOF detector 10, enabling HDX experiments at an expanded range of reagent gas pressures, e.g., $0.1\times10^{-3}$ mbar to $1\times10^{-1}$ mbar. The efficiency of deuterium labeling of proteins and peptides in the source-TWIG 12, however, was reduced relative to the transfer-TWIG 18 because very high $ND_3$ gas pressures in the source-TWIG 12 were required to achieve similar extents of HDX as corresponding experiments in the transfer-TWIG 18. For example, FIG. 7 shows the deuterium labeling or "uptake" of GFP in the source-TWIG 12. A likely explanation of the difference between FIG. 7 and FIG. 4A, is the interference to the exchange process of water vapor from the ion source region 19 adjacent to the source-TWIG 12.

Measuring Unfolded (Native) Protein Ions

Figure 8A:
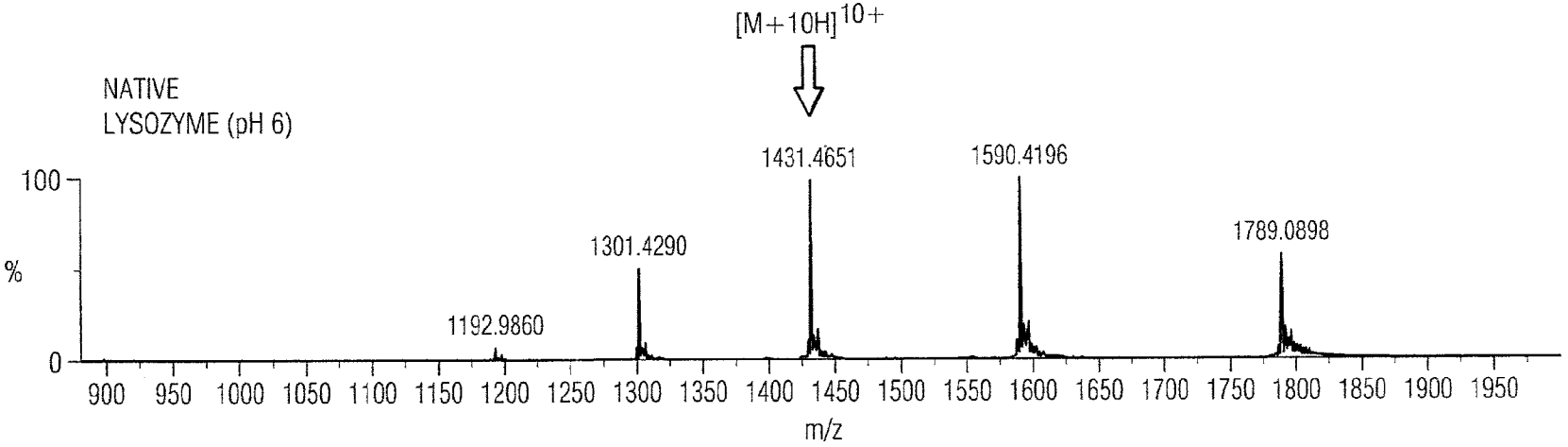
FIG. 8A shows mass spectra for a native form of lysozyme protein.
Figure 8B:
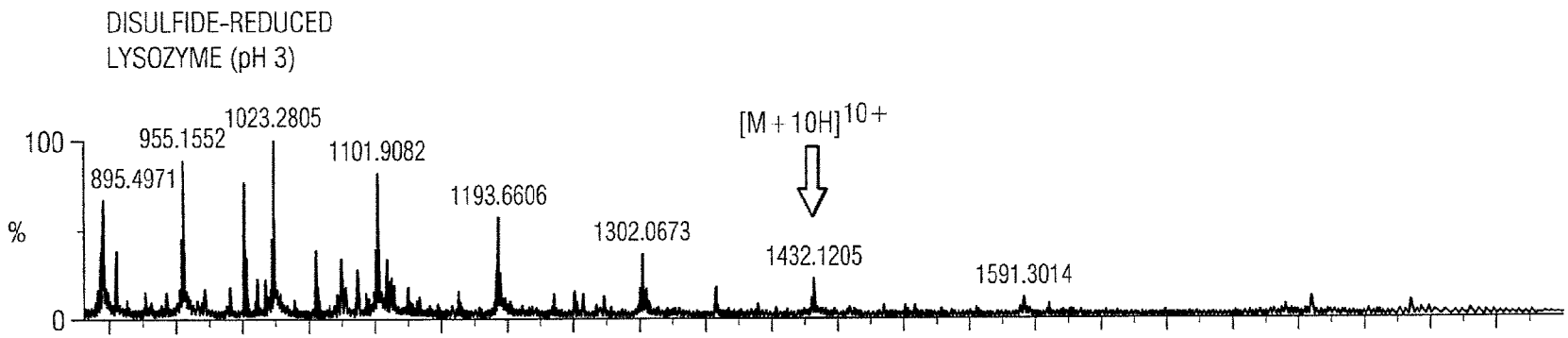
FIG. 8B shows mass spectra for a disulfide-reduced, non-native form of lysozyme protein.
Figure 9:
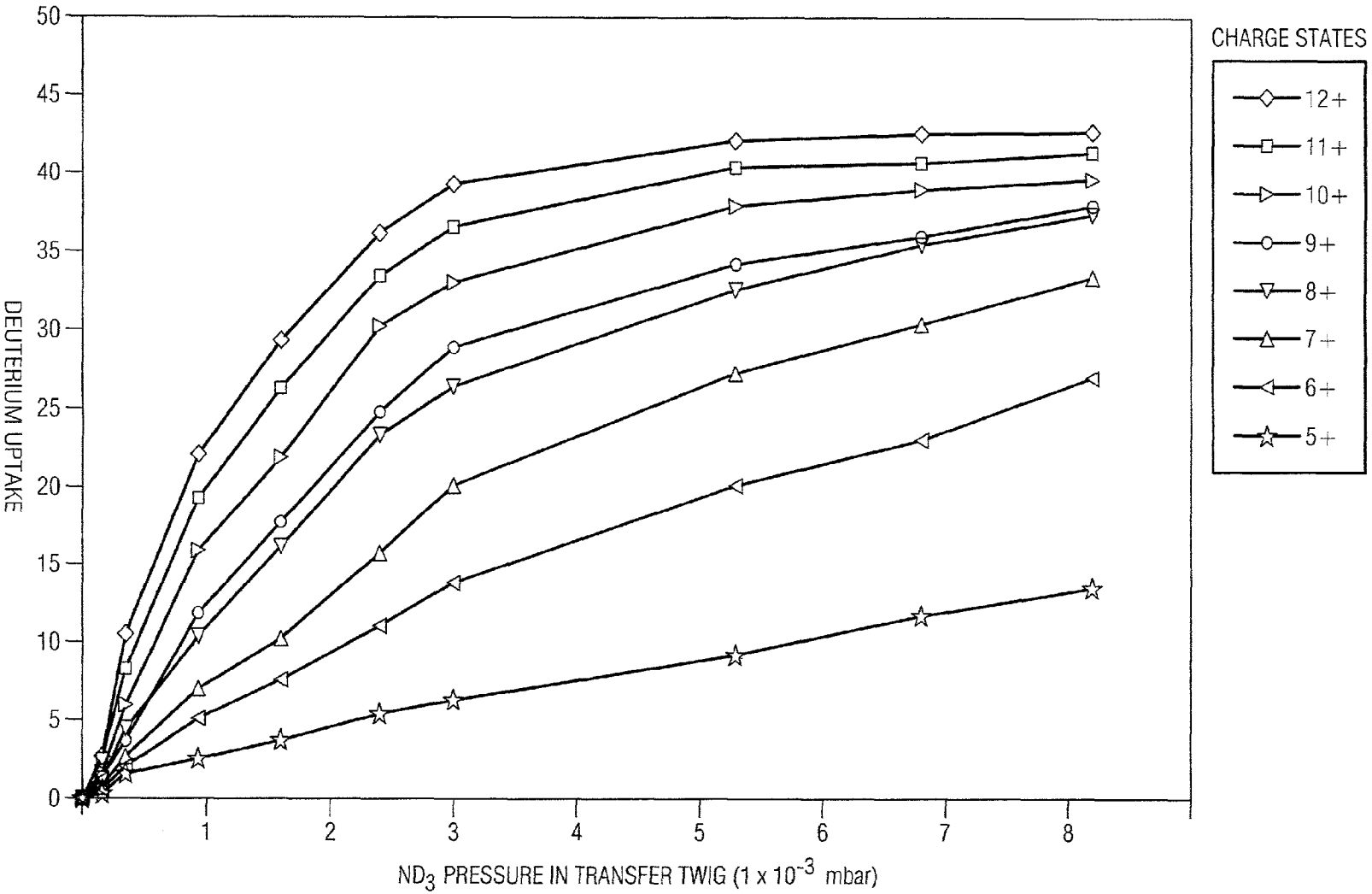
FIG. 9 shows a graph summarizing the effect of charge state of protein ions on deuterium uptake as a function of gas pressure.
Figure 10:
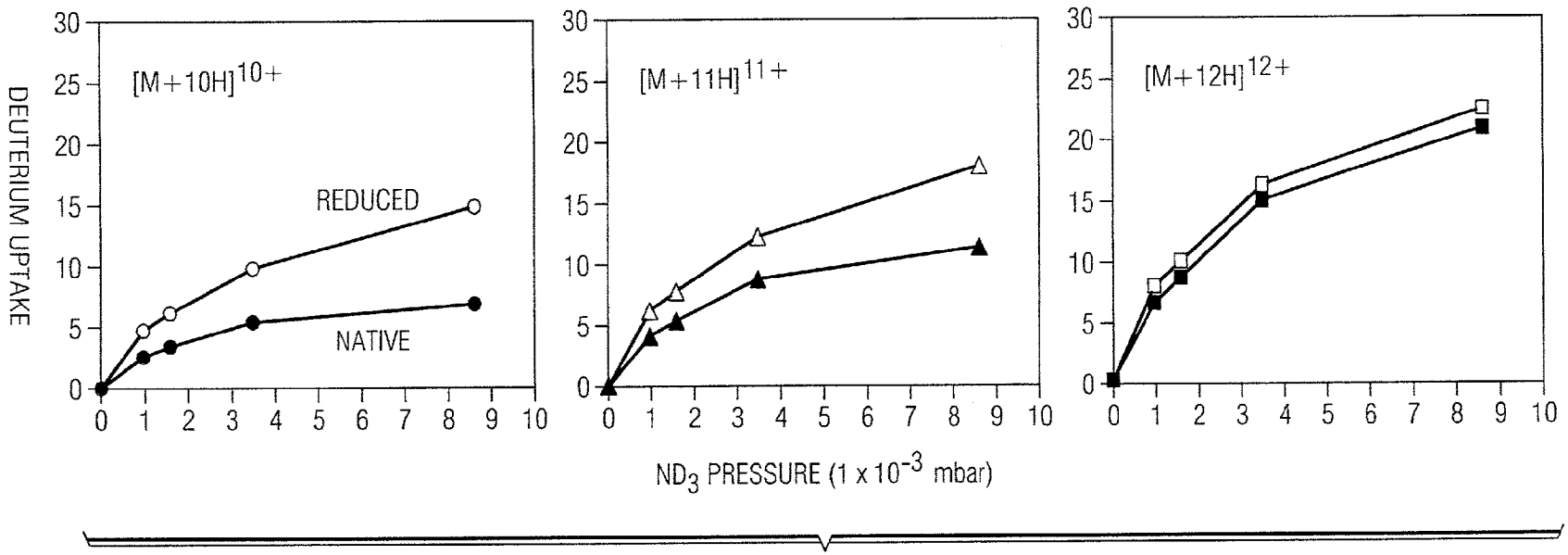
FIG. 10 show three graphs summarizing the effect of an ion being in either a native or a non-native (reduced) state on deuterium uptake as a function of gas pressure for three different charge states.

The sophistication of the present invention enables its use to conduct gas-phase HDX of proteins at native conditions, which is to say that, in the gas-phase, the proteins remain in a natural state such that there is no unfolding from the solution to the gas-phase. FIGS. 8A and 8B illustrate results from probing the difference between native lysozyme (pH 6) and a disulfide-reduced, more acidic lysozyme (pH 3). FIG. 9 shows a summary of deuterium uptake as a function of labeling gas pressure for various charge states from which the difference between compact ("lower charged") ions, e.g., 5+, and extended (higher charged") ions, e.g., 12+, is shown. FIG. 10 shows the deuterium uptake as a function of labeling gas pressure for both reduced ("unfolded") and native ("folded") ions for $[M+10H]^{10+}$, $[m+11H]^{11+}$, and $[M+12H]^{12+}$.

Collectively, the figures demonstrate that in a native state, in which the undiluted protein is more compact, deuterium uptake (and charge) is reduced whereas in an unfolded, non-native state, the deuterium uptake (and charge) are greater. As a result, deuterium labeling can also be used to determine whether or not the protein is folded or unfolded.

While the invention is described through the above-described exemplary embodiments, it will be understood by those of ordinary skill in the art that modifications to, and variations of, the illustrated embodiments can be made without departing from the inventive concepts disclosed herein. Accordingly, the invention should not be viewed as limited, except by the scope and spirit of the appended claims.

What is claimed is:

1. A method of interrogating conformational properties of gas-phase analyte ions in a traveling wave ion guide (TWIG), the method comprising:

infusing a reactive, isotopic labeling gas into a TWIG to create a curtain of isotopic labeling gas therein;

transporting gas-phase analyte ions through the curtain of isotopic labeling gas in the TWIG via a traveling wave; and generating isotopic exchange reactions between the gas-phase analyte ions and said isotopic labeling gas in the TWIG to label ions in the gas-phase conformation.

2. The method as recited in claim 1 further comprising transporting the labeled ions into a mass detector.

3. The method as recited in claim 1 further comprising controlling gas pressure or gas flow of the isotopic labeling gas within the TWIG.

4. The method as recited in claim 1 further comprising controlling a wave speed of the traveling wave.

5. The method as recited in claim 1 further comprising controlling a wave height of the traveling wave to prevent ion roll-over.

6. The method as recited in claim 5, wherein the wave height has a voltage potential of between 0.1V and 20V.

7. The method as recited in claim 6, wherein the wave height has a voltage potential of between 1V and 6V.

8. The method as recited in claim 1 further comprising performing ion mobility separation on the gas-phase analyte ions prior to transporting said gas-phase analyte ions into the TWIG.

9. The method as recited in claim 1 further comprising performing fragmentation by collisional activation or by ion-electron reactions of isotopically labeled gas-phase analyte ions before or after isotopic exchange in a TWIG.

10. The method as recited in claim 1, wherein the isotopic exchange reactions are hydrogen/deuterium exchange reactions.

11. A traveling wave ion guide (TWIG) for interrogating conformational properties of gas-phase analyte ions, the TWIG comprising:

an infuser for infusing a reactive, isotopic labeling gas into a TWIG to create a curtain of isotopic labeling gas labeling gas therein; and means for transporting the gas-phase analyte ions through the curtain of isotopic labeling gas in the TWIG via a traveling wave to generate isotopic exchange reactions between the gas-phase analyte ions and said isotopic labeling gas in the TWIG.

12. The TWIG as recited in claim 11 further compromising a valve for controlling a gas pressure or gas flow of the isotopic labeling gas within the TWIG.

13. The TWIG as recited in claim 11 further comprising means for controlling a wave speed of the traveling wave.

14. The TWIG as recited in claim 11 further comprising means for controlling a wave height of the traveling wave to prevent ion roll-over.

15. The TWIG as recited in claim 14, wherein the wave height has a voltage potential of between 0.1V and 20V.

16. The TWIG as recited in claim 15, wherein the wave height has a voltage potential of between 1V and 6V.

17. The TWIG as recited in claim 11 further comprising an ion mobility separator for separating the gas-phase analyte ions prior to transporting said gas-phase analyte ions into the TWIG.

18. A method of interrogating conformational properties of analyte ions after electrospray ionization of a sample solution into gaseous ions, the method comprising:

infusing a reactive, isotopic labeling gas into at least one traveling wave ion guide (TWIG) to create a curtain of isotopic labeling gas therein;

transporting the gaseous ions via a traveling wave through the curtain in the at least one TWIG;

generating isotopic exchange reactions between the gaseous ion and said isotopic labeling gas to label said gaseous ions; and transporting the labeled gaseous ions into a mass detector.

19. The method as recited in claim 18 further comprising at least one of the following:

infusing the reactive, isotopic labeling gas into a source TWIG;

infusing the reactive, isotopic labeling gas into a trap-TWIG;

infusing the reactive, isotopic labeling gas into a transfer-TWIG;

infusing the reactive, isotopic labeling gas into an ion mobility-TWIG;

transporting the gaseous ions through the source-TWIG;

transporting the gaseous ions through the ion mobility-TWIG;

transporting the gaseous ions through the trap-TWIG;

transporting the gaseous ions through the transfer-TWIG; and transporting the gaseous ions through a quadrupole.

20. The method as recited in claim 19, wherein transporting the gaseous ions through the mobility-TWIG includes:

generating a traveling wave through a center annular region of the mobility-TWIG, the traveling wave having a wave height;

infusing a bath gas into the mobility-TWIG at a first pressure; and controlling the wave height of the traveling wave to promote ion roll-over due to cross-section attributes of the gaseous ions.

21. The method as recited in claim 18, wherein infusing the reactive, isotopic labeling gas into at least one TWIG includes:

generating the traveling wave through a center annular region of said at least one TWIG, the traveling wave having a wave height; and controlling the wave height of the traveling wave to prevent ion roll-over therein.

22. The method as recited in claim 18 further comprising controlling a wave velocity of the traveling wave traveling through the at least one TWIG.

23. The method as recited in claim 18 further comprising controlling a gas pressure or a gas flow of the isotopic labeling gas that is infused into at least one TWIG.

24. The method as recited in claim 18 further comprising performing ion mobility separation on the gas-phase conformation prior to transporting the gaseous ions through the curtain of isotopic labeling gas in the at least one TWIG.

25. The method as recited in claim 24, wherein:

ion mobility separation occurs in an ion mobility TWIG, in which the wave height of the traveling wave induces analyte ion in the traveling wave to roll-over as a function of collisional cross-section of the analyte ions, to provide a first dimension of separation of conformations.

26. The method as recited in claim 25, wherein:

gas-phase, isotopic labeling occurring in the curtain of said isotopic labeling gas in the at least one TWIG provides a second dimension of interrogation of conformations in a direction orthogonal to the first dimension of interrogation.

27. The method as recited in claim 18, wherein labeling each of the gaseous ions transpires over a same labeling time as a function of a wave velocity of the traveling wave.

28. A traveling wave ion guide device for use in a mass analyzer of a mass spectrometer, the traveling wave ion guide device comprising:

a plurality of electrodes that are adapted and controlled to generate a traveling wave through a center annular region thereof, the traveling wave having a wave height and a wave speed; and a gas inlet for infusing a reactive, isotopic labeling gas into the device to create a curtain of the isotopic labeling gas about the plurality of electrodes, wherein said labeling gas generates gas-phase, isotopic exchange reactions with any gaseous analyte ions being transported by the traveling wave.

29. A traveling wave ion guide system for use in a mass spectrometer, the traveling wave ion guide system comprising:

a source of a reactive, isotopic labeling gas;

a plurality of electrodes that are adapted and controlled to generate a traveling wave through a center annular region thereof, the traveling wave having a wave height and a wave velocity; and a gas inlet for infusing the isotopic labeling gas into the device to create a curtain of said isotopic labeling gas about the plurality of electrodes, wherein said isotopic labeling gas generates gas-phase, isotopic exchange reactions with any gaseous analyte ions being transported by the traveling wave.

30. A mass spectrometer comprising:

an ion source that is adapted to provide gas-phase analyte ions via electrospray ionization;

a source of a reactive, isotopic labeling gas;

a mass analyzer having a traveling wave ion guide (TWIG) for interrogating conformational properties of the gas-phase analyte ions;

means for infusing the isotopic labeling gas into the TWIG; and a mass detector.

* * * * *